US006109456A

United States Patent [19]

Heinz

[11] Patent Number: 6,109,456

[45] Date of Patent: Aug. 29, 2000

[54] SUPPORT DEVICE FOR HANGING SHEETLIKE OBJECTS USING THIN SUPPORT TABS

[76] Inventor: Ted Heinz, 33694 Colgate Dr., Union City, Calif. 94587

[21] Appl. No.: 09/458,236

[22] Filed: Dec. 9, 1999

Related U.S. Application Data

[63] Continuation-in-part of application No. 09/218,657, Dec. 22, 1998, abandoned, which is a continuation-in-part of application No. 08/895,346, Jul. 16, 1997, abandoned, which is a continuation-in-part of application No. 08/724,011, Sep. 30, 1996, Pat. No. 5,890,604.

[51] Int. Cl.[7] ..... A47F 7/16

[52] U.S. Cl. ..... 211/46; 211/106; 312/184

[58] Field of Search ..... 211/45, 46, 47, 211/48, 57.1, 59.1, 171, 94.02, 106; 312/183, 184; 40/611, 617

[56] References Cited

U.S. PATENT DOCUMENTS

| | | | |
|---|---|---|---|
| 651,170 | 6/1900 | Thomas | 211/48 |
| 1,240,611 | 9/1917 | Smith | 211/48 X |
| 1,687,859 | 10/1928 | Fontaine | 312/184 |
| 1,711,070 | 4/1929 | Suydam, Jr. | 211/46 X |
| 3,295,471 | 1/1967 | Cook | 211/106 X |
| 4,343,405 | 8/1982 | Virte et al. | 211/106 X |
| 5,398,824 | 3/1995 | Wolff et al. | 211/106 X |
| 5,690,238 | 11/1997 | Schmehr | 211/106 |
| 5,934,489 | 8/1999 | Dusel et al. | 211/46 X |

*Primary Examiner*—Peter R. Brown
*Assistant Examiner*—James O. Hansen
*Attorney, Agent, or Firm*—Paul F. Schenck

[57] ABSTRACT

Holding frames for hanging sheets of documents, such as posters and charts for storage, retrieval and reorganization of the stored items. Each stored sheet has one or more flat flexible plastic tabs with holes and slits attached to the back top edge. The spacing of the tabs matches the width of the storage frame. The holding frames can be used in two positions, a storage position and a selection position. In the selection position the stored items are easy to separate, review and locate. In the storage position the items are packed tightly. The holding frames are removable from the hanging facility to change the position or for transportation to different locations.

18 Claims, 26 Drawing Sheets

SUPPORT DEVICE FOR HANGING SHEETLIKE OBJECTS USING THIN SUPPORT TABS

This is a continuation-in-part application of my application Ser. No. 09/218,657, filed Dec. 22, 1998, status abandoned, which is a continuation-in-part application of my application Ser. No. 08/895,346, filed Jul. 16, 1997, status abandoned, which is a continuation-in-part application of my application Ser. No. 08/724,011, filed Sep. 30, 1996, issued as U.S. Pat. No. 5,890,604 on Apr. 6, 1999.

BACKGROUND OF THE INVENTION

The present invention relates to systems for storage of graphics, charts, maps, posters and similar objects, which are referenced in the following and in the claims as posters or charts without restricting the objects which can be stored using the present invention to the same. It is particularly applicable for posters and charts ranging from less than 15" to 30" in width and from less than 10" to more than 40" in height. This invention is of particular importance for use in classrooms where many different didactic and decorative posters and charts are displayed and used as part of an ongoing curriculum. Because they are often changed to support the progression of the learning process, it is important to have an efficient and easy system for handling and storing these relatively large flat items or objects. And there are many other professions and settings where this invention will be useful. This invention provides a new type of tab/hook device for hanging posters and charts or the like in a simple and flexibly fashion and allows to establish an order to organize easy storage and retrieval. Furthermore, a tool is disclosed for attaching tabs/hooks to a poster, chart or the like object. In the following disclosure of the present invention the tab/hook device is referenced as a tab without diminishing its feature as a hook for hanging an object on a rack.

A storage rack is disclosed, which exhibits significant features as a rack for storing objects, as a device for transporting items, a rack for easily selecting and removing one or more items from a group of items as well as using it as a hanger during selective display of individual items out of a series of items.

DISCUSSION OF PRIOR ART

There are existent various methods for dealing with storage and retrieval of posters and charts. It is usually believed best to store posters laying flat on large flat selves. But such flat files generally take too much horizontal space (especially in classrooms where space is at a premium) and are not very handy for reorganizing and locating particular filed objects. Sometimes very large envelopes or cardboard folders are used. However, placing and removing posters and charts from such envelops is time consuming; and storage of these containers is still a problem. Often the tops of cabinets are used for storing such objects; but climbing up on a chair to get a stored item from somewhere in the stack of stored items is a dangerous hassle. Another space consuming arrangement is a large V shaped box which allows posters with cardboard dividers to lie inclined while permitting easy review and retrieval.

Often posters and charts are rolled up. Storage of these rolls can become at best haphazard; and it is difficult to handle the posters or charts after they are opened up because they tend to roll back up. At times one is tempted to mount the posters; but this is expensive and bulky solution. Another popular way to hang a poster without mounting is using two ribs, one at the top another at the bottom. A long triangular extrusion clamps onto the top of the poster with the other along the bottom. A string is threaded through the opening of the top rib in order to hang it. This is handy because it can be handled easily. It can be rolled up easily and unrolled. It hangs straight because of the weight of the bottom rib. However, these ribs are not altogether inexpensive. And, unlike the present invention, they are bulky, not allowing compact storage when handling a large number of posters. As can be appreciated, expense, the use of valuable space, and the lack of easy handling present problems for teachers who want to use these valuable didactic and motivational tools.

Didactic flip charts present less of a storage problem in the classroom. Flip chart racks holding a series and sequence of charts to be presented to students are common in classrooms. Charts with holes punched in the top are threaded on rings allowing the charts to hang and be flipped over to the back as each is used in teaching a lesson. Although most chart racks can hold quite a large number of charts not in use without taking up significant space, they still present a problem when it comes to reorganizing. The main problem being that charts must be threaded onto the rings in a set sequence. If the sequence is to be changed the charts have to be removed, rearranged and then rethreaded.

The following patent has some relationship to the present invention: U.S. Pat. No. 4,403,883 is a suspension filing system. Other products which some remote similarities to the thin snap-on tab of the present invention:

- plastic labels which easily slip and snap into place on the stem of a nursery plants;
- cardboard tags which slip onto the review mirror support of automobiles, e.g. at the automobile repair shop.
- plastic ruler/page marker that snaps on and off the rings of the DAY RUNNER PERSONAL ORGANIZER™ notebook;
- the cards on a ROLODEX™ rotary file;
- certain flat plastic tab/hooks used to hold items for sale on display supports.

OBJECTS OF THE INVENTION

It is an object of the present invention is to provide for a convenient and economical devices for storage and retrieval of posters, charts and the like of different sizes.

DESCRIPTION OF THE INVENTION

In the present invention one or more flat bendable plastic tabs, acting as hooks, which easily open and automatically close, are attached to the top edge of the posters or charts. These tabs are spaced at a preestablished intervals and preferably centered and symmetrical on the top edge of the poster or chart. (Alternatively one long tab, including one or more hooks, may be used spanning the same distance at the top of the poster or chart.)

In order to hang a poster or chart, these tabs are snapped onto the rods or rings of a holding rack. Because the posters and charts are hanging they are easy to spread out, to separate and review for retrieval of a particular one. And because the tabs are flexible, individual posters or charts may easily be removed and placed in any other position within the established sequence of posters or charts. As an organizing aid, dividers may be introduced like in a file, and the tabs can be provided in various distinguishing colors. This works especially well if viewed from the top. The hanging posters or charts, separated by the categories established by the dividers, can be slid and separated on the rack so as to see and confirm the category and location of any particular posters or charts desired.

In many classrooms a variety of didactic and decorative posters and charts are displayed and used as part of an ongoing curriculum and periodically must be changed to support the progression of the learning process. Because of many demands in the schools: space, time, and economy are of utmost importance. This invention provide for a means for hanging posters and charts simply and flexibly in a way that permits a teacher to easily organize (and reorganize) for storage and retrieval. Individual posters or charts may be quickly removed or returned to any position within the sequence of hanging posters or charts. The tab is generally very close to the same thickness as most charts and posters; thus, very little space is needed. The difference being that: stacked they use considerable valuable horizontal space, whereas hanging they do not; rather, a manageable vertical slice. This compact set of hanging posters or charts can be placed against the wall or within the parameters of a chart rack. The tab do not distract from the normal use of the posters when put on display.

In the preferred embodiment the tabs are transparent and are attached to the poster or chart using transparent tape and if used to support the posters when they are hanging, do not distract from it because you can't see them. Push tacks can be left on the walls and posters easily changed, putting the new one in exactly the same place without the hassle of untacking and retacking. Or, alternatively, because they are very thin, they may be left back behind the poster when it is hung on the wall.

If viewed from the top a set of hanging posters or charts can be used much like a file cabinet. Dividers may be introduced as part of a specifically established filing system. The hanging posters or charts, separated by the categories identified by the dividers or the color of the tabs, can be slid and separated on the rack so as to see and confirm the location of any particular one(s) desired. Besides being of great use in classrooms this invention has applications in many other settings, such as:

stores specializing in posters, prints, maps, etc.;

libraries, likewise for posters, prints, maps, etc.;

offices and businesses dealing with graphics such as engineers, architects and graphic designers.

Some variations of this invention are:

besides using two separate tabs, long tabs might also be used. A long tab along the entire top edge would provide added support for very thin or flimsy sheets. (However, with most posters and charts it was discovered to be unnecessary.)

Holes can be spaced and located identically as in the two precisely located individual tabs. Such items would fit on the same double rod rack.

A thicker tab or multiple tabs can be used for heavy charts and maps.

A long tab at the bottom could add some weight and rigidity to make a poster hang straighter.

A long tab with one hole at the center could support a chart or poster the same as two tabs if the long tab is at least as long as two tabs are spaced apart, while providing even more ease for handling. Depending on the setting, this would have some advantage. A one rod rack would be used. It would be somewhat simpler to handle in viewing, placing and removing from the rack or display tacks on the wall. The disadvantage is the greater cost because more plastic is used and will sustain less weight because there is only one point of support instead of two.

Easy release adhesive tape could be used, especially on the single long tab. This would be particularly useful in a store that sells prints. Once a customer has bought a poster it could be removed from the single long tab which could be then reused for another poster.

In the classroom setting it can be used to hold bulletin board materials. Tabs can be used to hang plastic bags or sleeves. Double long tabs might be used on each side of the open end of large rectangular plastic bags. The double long tabs would be placed along the top edges of opposite sides of the bag.

Large folders can be hung in which any number of large flat materials are filed. In the classroom, this could be items such as bulletin board materials, student artwork, etc.

The basic element of this invention is the flexible tab attached to the top edge of a poster or chart. However, this requires some kind of a rack consisting of one or more protruding rods, pegs or knobs on which the tabs snap to support the hanging poster or chart. Many different types of racks can be used, even as simple as one or more nails or push pins spaced properly apart on a wall. The tab consists of a thin plastic (in the preferred embodiment Mylar™ plastic 0.010" thick for posters and individual display charts, and 1/32" polycarbinate plastic for flip charts). Tabs have one centrally located hole, or a plurality of symmetrically arranged holes, each hole being large enough to accommodate, with some extra space, the diameter of the rod on which it is to hang. The tab is split, from the top or side in a straight or curved line, to the hole. This allows the rod to pass along the slit (which flexes open) and into the hole. The tab then snaps back to its original position enclosing and holding onto the rod. There are three types of tabs:

1) individual (usually in pairs);
2) long (for single rod or to provide added support); and
3) heavy duty with elongated slot shaped hole (for flip charts).

Within each of these types a variety of shapes are possible:

more rounded than square;

with bulge around hole of long tab/hook and thinner in rest of extension; etc.

The shape of the tabs do not effect the basic principles of this invention: thin tabs/hooks which allow the insertion of a rod by way of a flexible slit (or wider opening) into an area which is closed over the rod and rigid enough to support the weight of the poster or chart. The tabs in the preferred embodiment are transparent. However, for classifying the attached chart or poster, colored tabs can be used. Tabs are attached with adhesive tape (transparent in the preferred embodiment) in such a way that the tab but-up against the top edge of the poster or chart and an adhesive bridges from a tab surface to the surface of the attached chart or poster. In the preferred embodiment the tab has an area for receiving the adhesive tape and an area in which the opening and the slit is located. However the adhesive tape may be attached to the whole tab if provisions are made to cut out the hanging opening and the slit. In another version the tab may have a recessed area with an adhesive material which can be attached directly to a chart or poster, as well as a longer tab with adhesive on the lower end that will overlap and hold the top of the chart. However, such a design requires a thicker tab, which lowers the efficiency of the hanging storage. For high efficiency storage the thickness of a tab is generally very close to the thickness of the charts and posters and it should not exceed double the thickness of a chart or poster attached to it. This allows the posters and charts to be bunched together and to occupy practically no more volume than if the posters and charts were stacked flat without the tab/hooks. At a thickness of no more than 1/64" fifty to sixty posters hang easily within each inch of rod space.

Various aids for correct positioning and mounting are possible. It is important to have attachment guides which determine the exact distance (14" in the preferred embodiment) between the tabs, as well as for centering the tabs along the top edge of the poster or chart. Also, precut clear adhesive tape on release paper may be provided; or, clear adhesive tape may be integrated into the product during manufacture with release paper to be removed just before attaching the tab/hook in the correct position.

The parts of the rack arrangement for storing posters or the like, include a frame for receiving the hanging tabs or hooks, and a mounting plate for holding the frame to a wall in one of two positions, one position for space saving storage, the other for spreading the stored group of posters out for accessing posters from among the group of posters.

SHORT DESCRIPTION OF THE DRAWINGS

FIGS. 8*a* through 8*e* are illustrations of tabs with alternative types of slits.

Figure 9A:
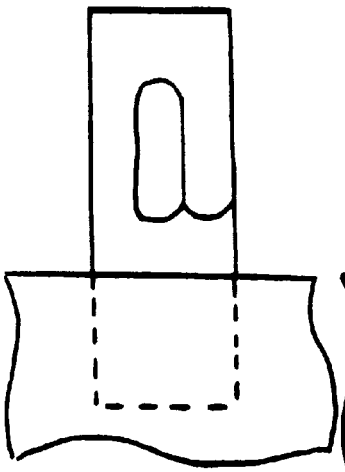
Figure 9B:
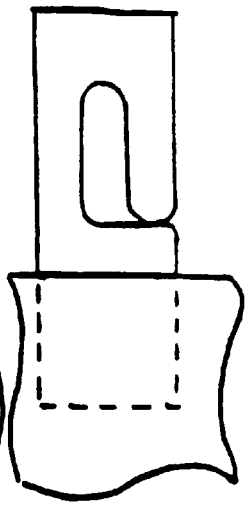
Figure 9C:
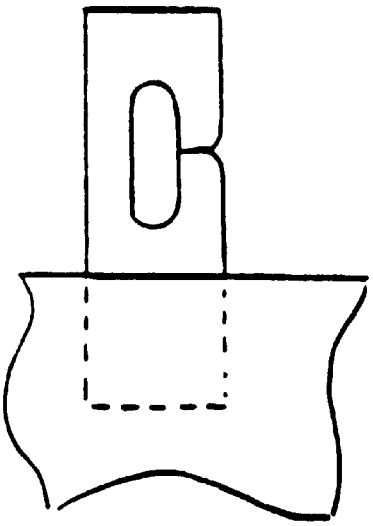

FIGS. 9*a* through 9*c* are illustrations of tabs with elongated openings and alternative slits for use with flip charts.

Figure 10:
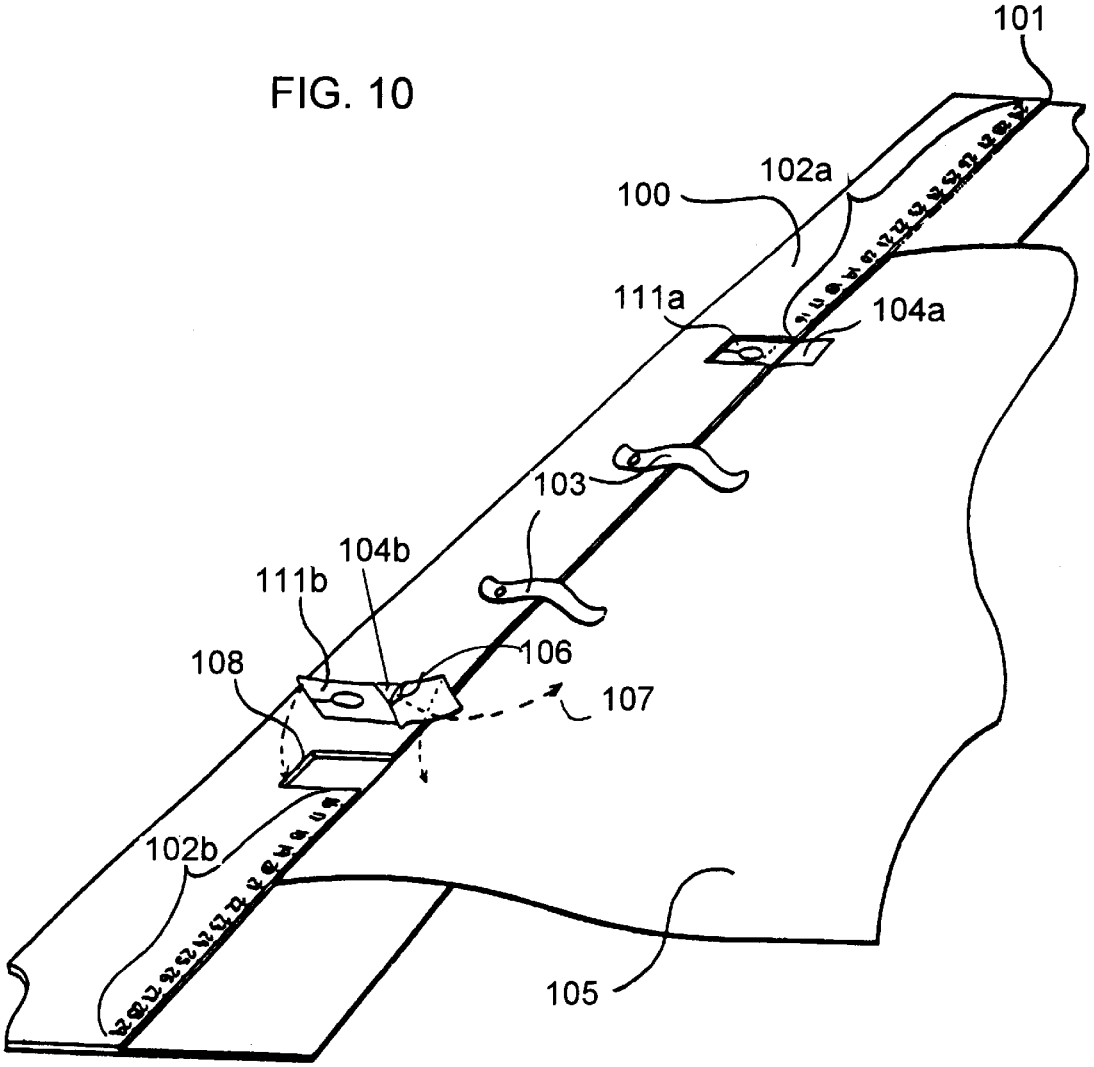

FIG. 10 is an illustration of a centering device for attaching tabs of the present invention to charts, posters, and the like.

Figure 11:
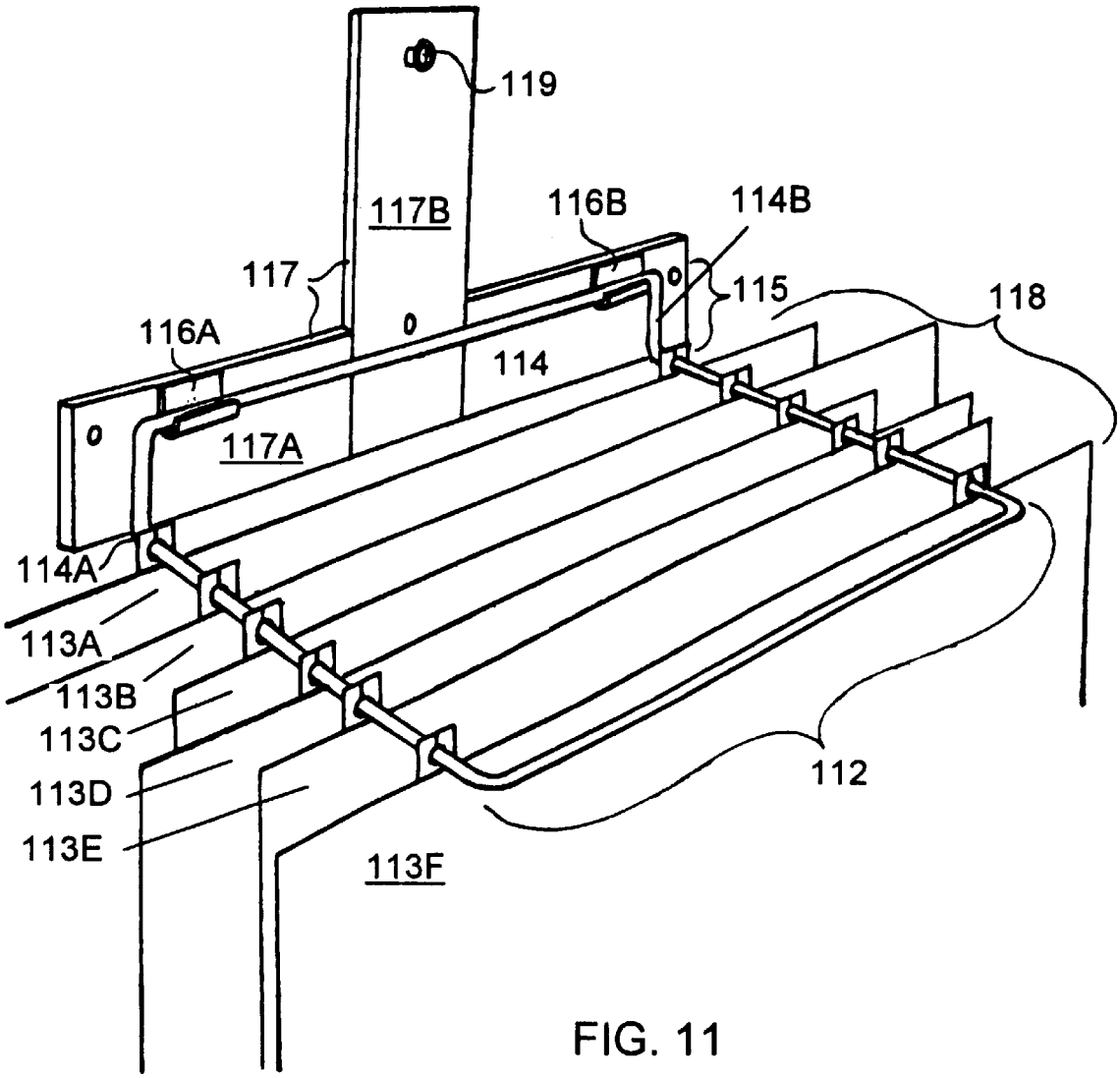

FIG. 11 is an illustration of a storage rack and the associated mounting plate in access position.

Figure 12:
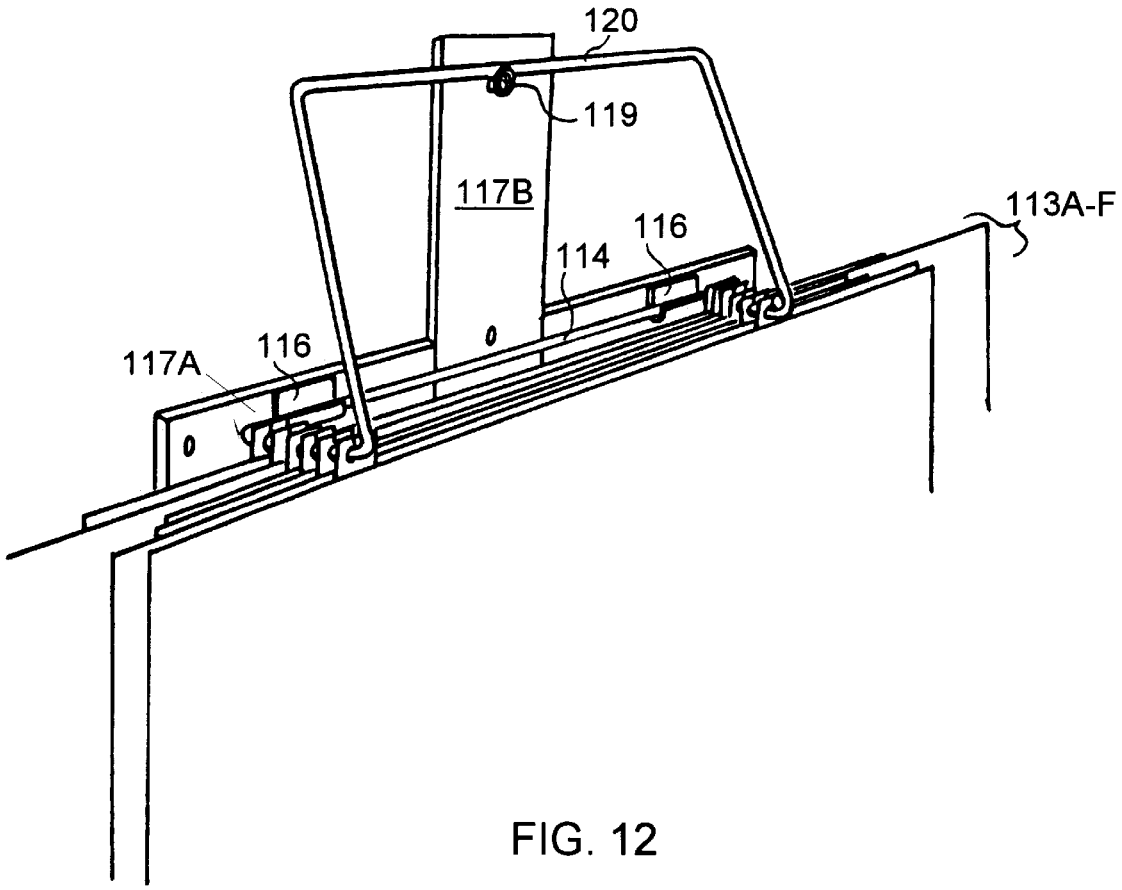

FIG. 12 is an illustration of the storage rack of FIG. 11 in storage position.

FIG. 13A through 13H are illustrations of mounting means for holding a frame in the storage position and in the selection position, respectively.

Figure 14:
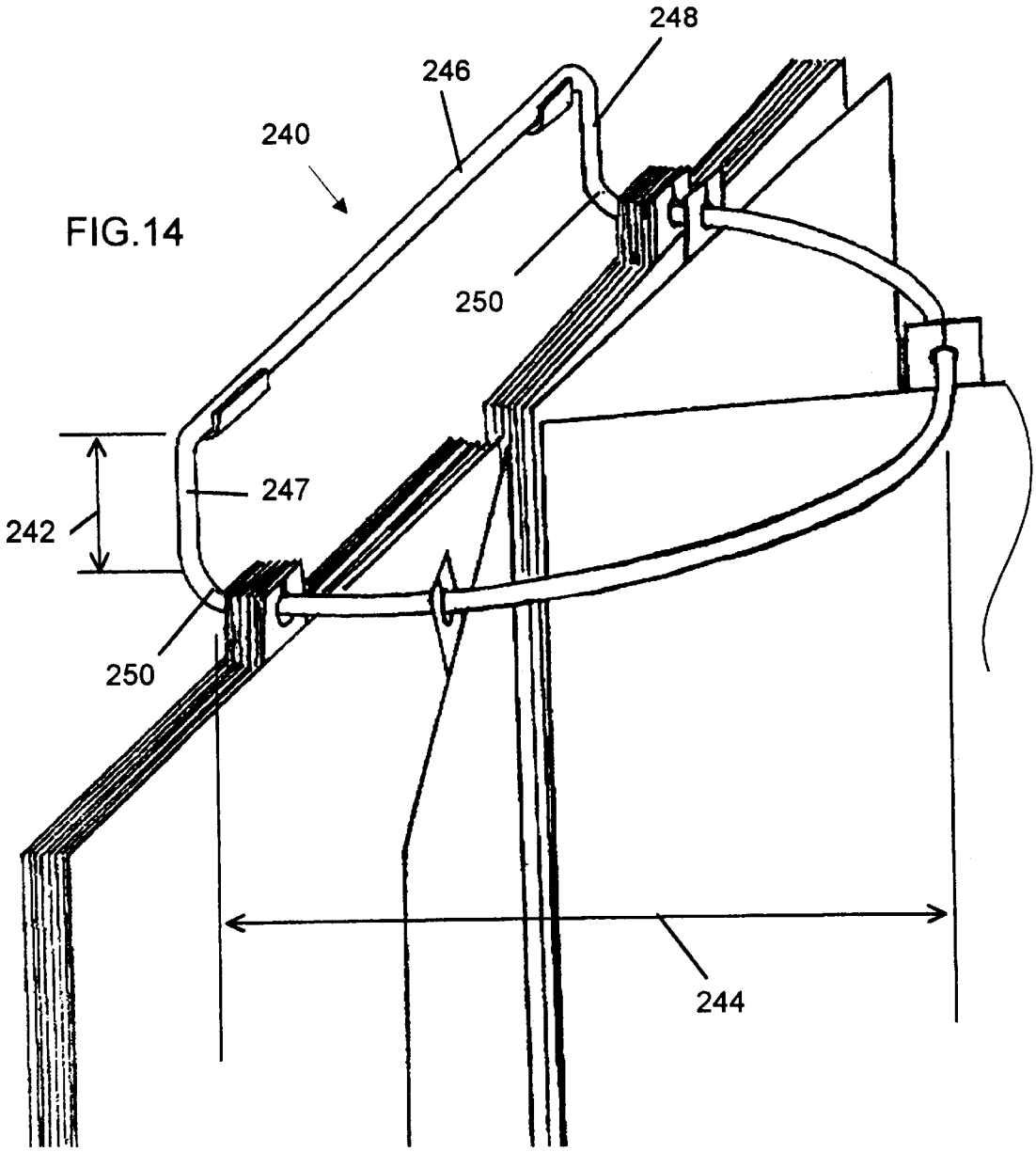

FIG. 14 is an illustration of a second implementation of the holding frame

FIG. 15A–15E are illustrations of various cross-sections of the side bars and curved sections of the holding frames FIGS. 16A–16D are illustrations of a family of open holding frames for sheetlike objects.

Figure 17A:
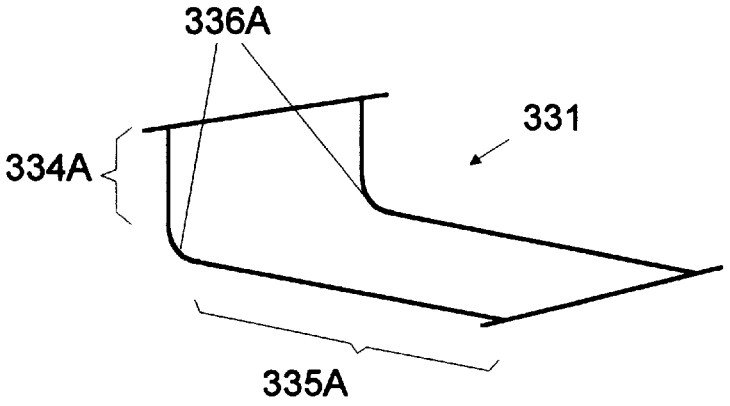
Figure 17B:
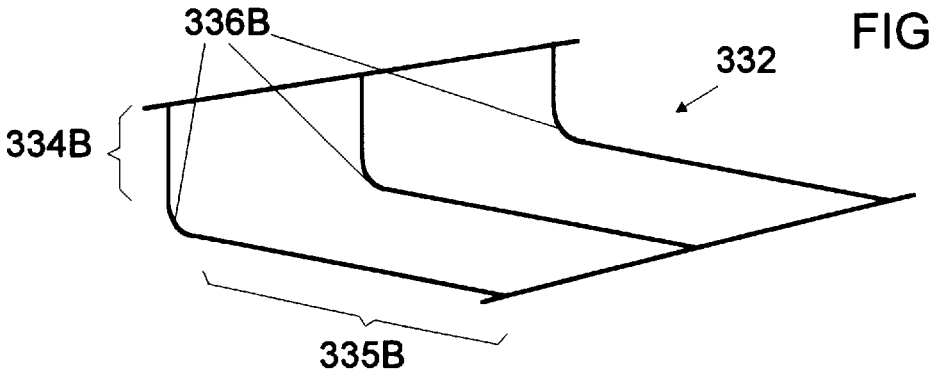
Figure 17C:
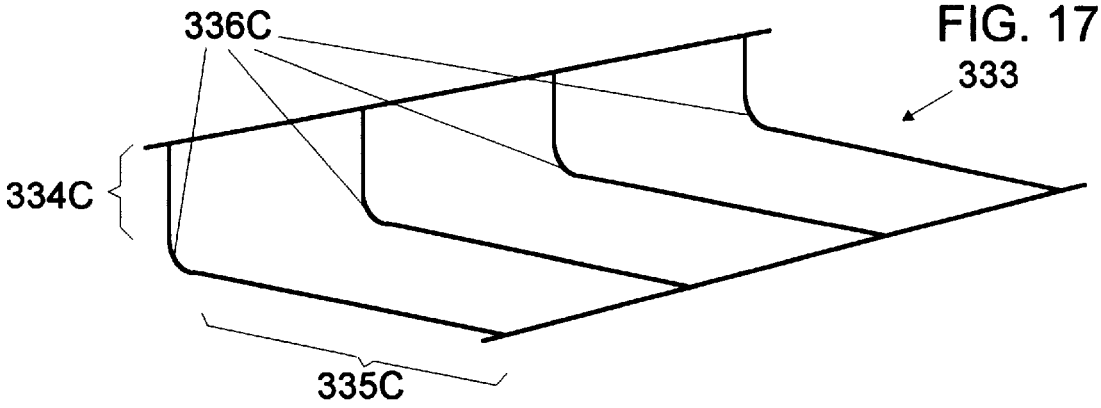

FIGS. 17A–17C are illustrations of a family of closed holding frames for sheetlike objects.

FIGS 18A–18G are illustrations of open holding frames and closed holding frames with two storage positions for sheetlike objects.

Figure 19A:
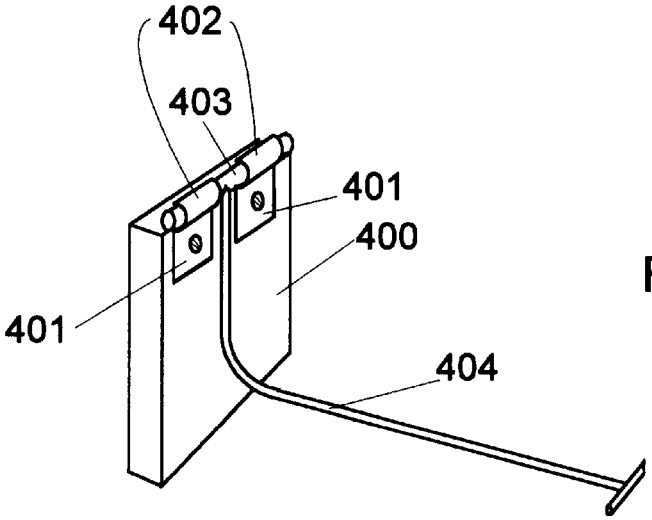
Figure 19B:
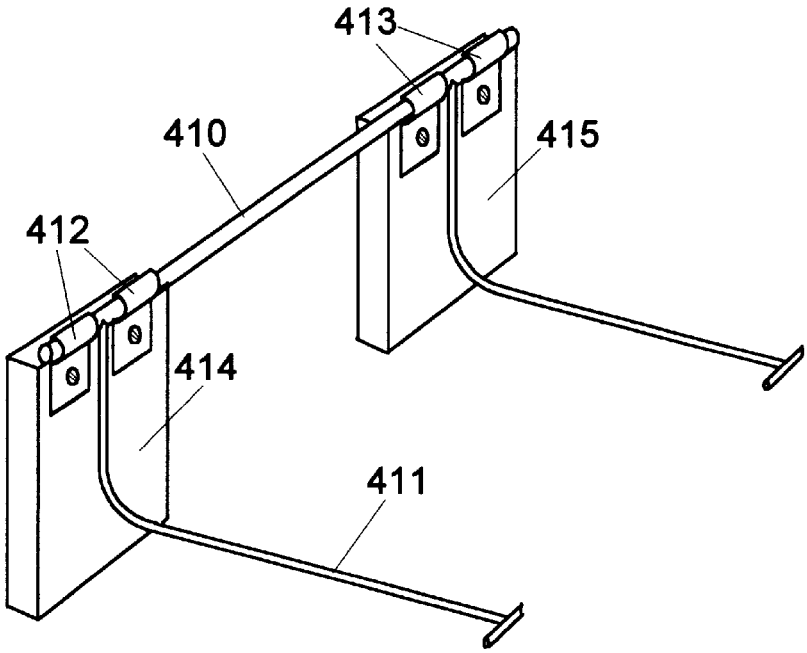

FIGS. 19A and 19B illustrations of how single stick and open and closed holding frames are held in selection position using one or more mounting plates.

FIGS. 20A–20E are schematic illustrations of the various mounting possibilities for holding sticks, and for open and closed holding frames with one or two storage sections.

Figure 21:
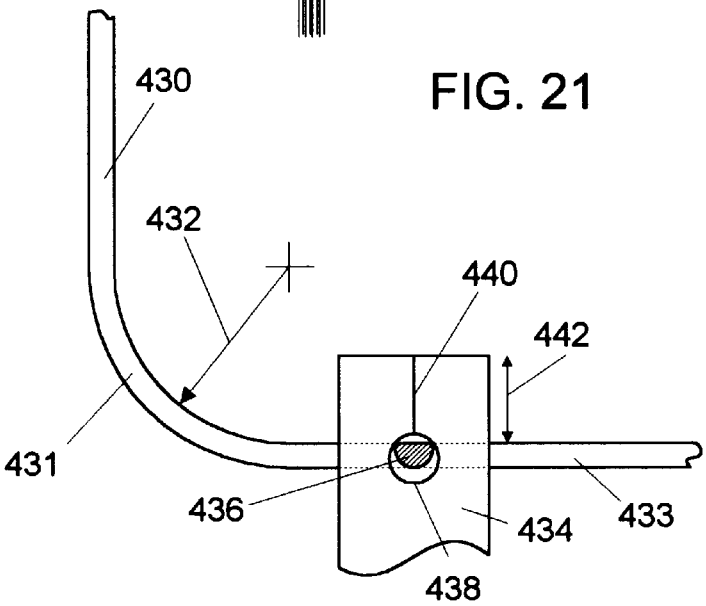

FIG. 21 is a illustration of a curved section and a tab.

DESCRIPTION OF THE PREFERRED EMBODIMENTS

Figure 1:
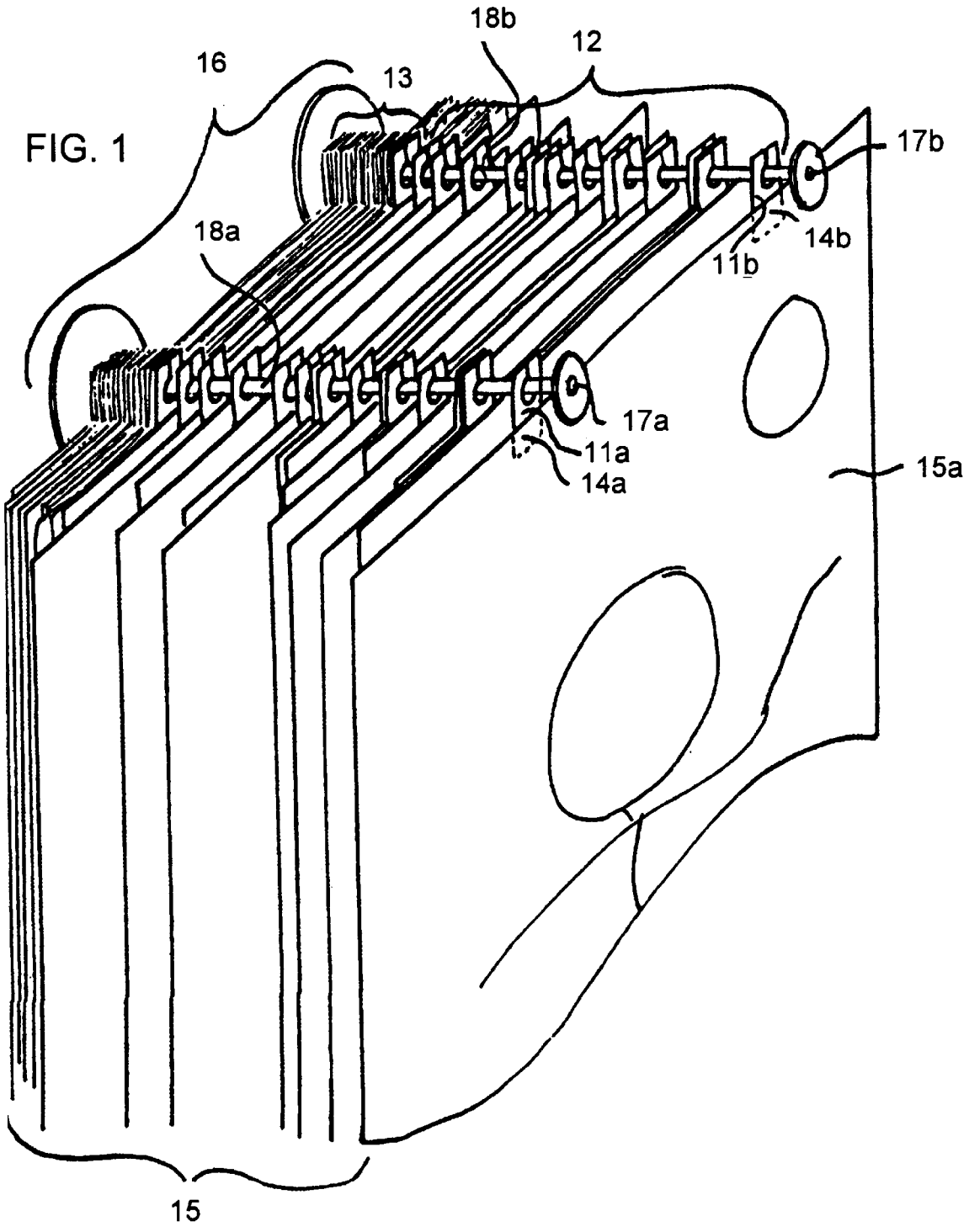
FIG. 1 is an illustration of posters hanging by precisely spaced tabs on a two rod rack.

FIG. 1 is an illustration of a plurality of posters 15 hanging on a two rod rack 16. In the preferred embodiment the rods 18*a* and 18*b* of rack 16 are spaced 14" apart, center to center. Wall mounts hold rods 19*a* and 19*b* and end stops 17*a* and 17 keep posters from sliding off. Tabs 11*a* and 11*b* are precisely spaced and centered on poster 15*a* to fit on the rods 18*a* and 18*b*. Most posters commonly used in the classroom measure at least 15" in one of their dimensions. And, for most posters, the maximum of the shorter side is 30". Spacing the tabs at 14" apart leaves a maximum of 7½" of poster top edge extending unsupported beyond the tabs on either side. Practically all posters are rigid enough so that the 7½" of unsupported extension will not sag. Those that would sag over time are generally kept straight by the adjacent posters, especially when bunched together as a group of posters 13. Tabs 11*a* and 11*b* of the preferred embodiment are 1" square and of 0.010" thick Mylar™ plastic. Transparent tape 14*a* and 14*b* is used to attach tabs 14*a* and 14*b* to a poster 15 and are generally about 0.0056" thick. Combined thickness of tape 14*a* and 14*b* and tabs 11*a* and 11*b* is thus about 0.0156 or 1/64". Therefore more than 60 posters can be held bunched together 13 on one inch of rod length. Posters may be spread out for review as demonstrated with posters of group 12. Size and design of the rack is important relative to the situation of use: amount and placement of space available, the number of posters to be stored, etc. However this disclosure addresses only the tabs and the essential element of supporting rods.

Figure 2:
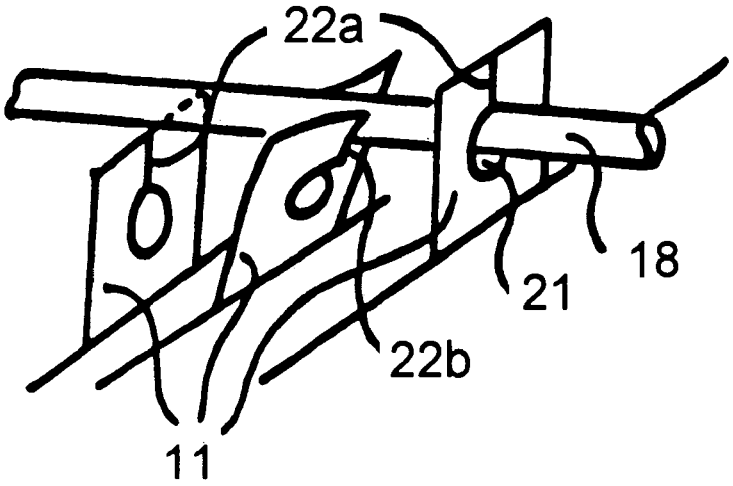
FIG. 2 is an illustration of the tab flexing open and snapping back into place onto the rod.

Attaching a poster with a tab of the present invention to a hanging rod is illustrated in FIG. 2. First and last tabs 11 have the slits 22*a* in normal closed position. The middle tab 11 is shown with an open slit 22*b* for moving the tab on or off rod 18. The size of the rod may vary; in the preferred embodiment it is about ¼" and the hole 21 in the tab 11 is ⅜" allowing room for movement back and forth on the rod 18.

Figure 3:
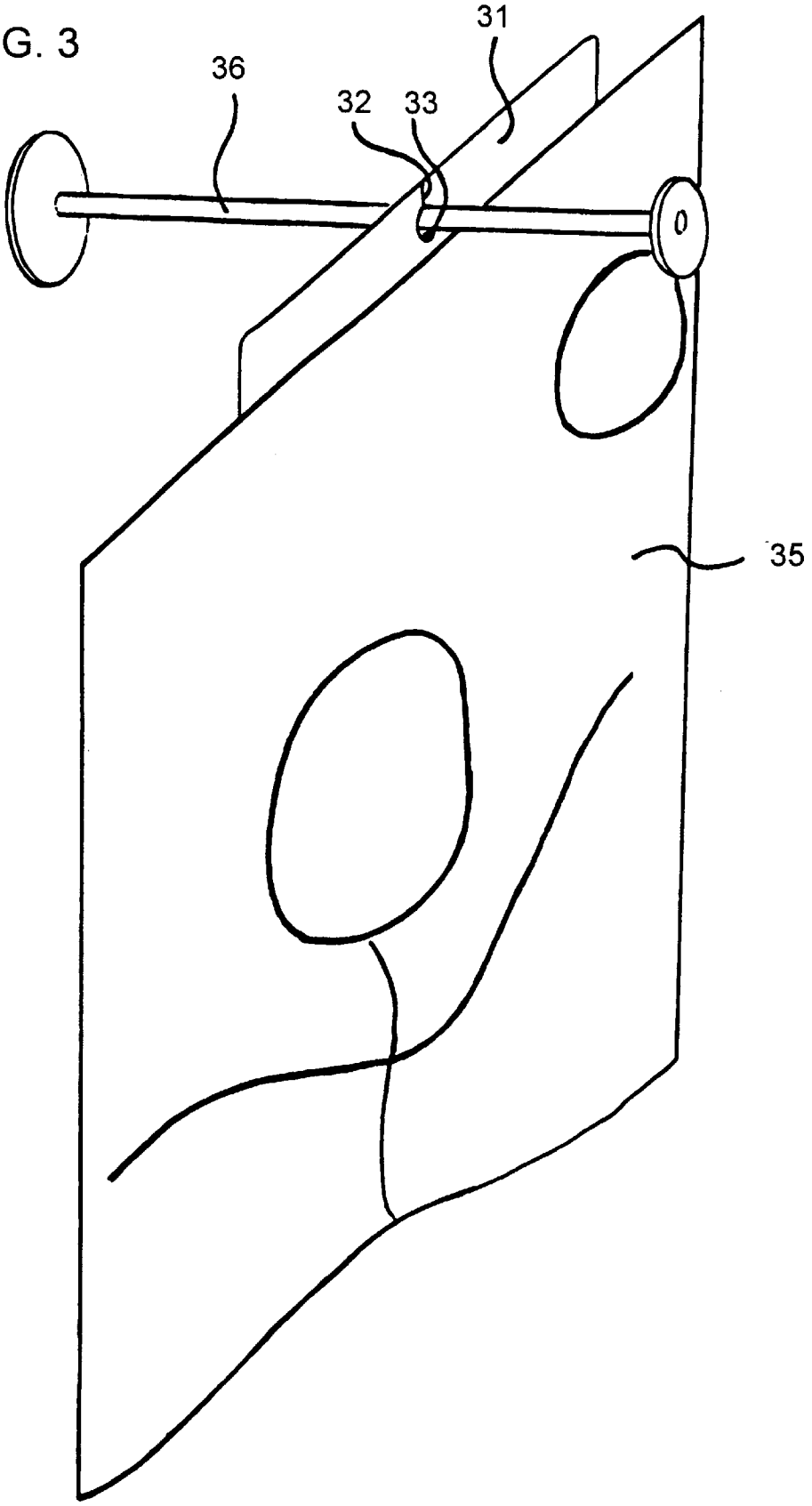
FIG. 3 is an illustration of a poster hanging by a long tab on a single rod rack.

FIG. 3 shows a poster 35 hanging on a single rod rack 36 by a long tab 31 with a single centered hole 33 and slit 32. A long tab 31 measures at least 15" long to accommodate the range of size and rigidity of posters as explained above for FIG. 1.

Figure 4:
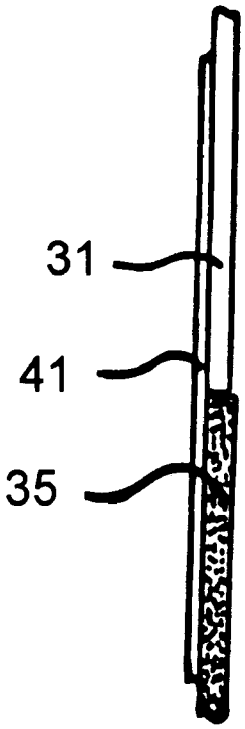
FIG. 4 is a side view of a tab being attached to a poster or chart.

FIG. 4 is a side view of a tab 31 which is attached to a poster 35 using an self-adhesive tap 41. It illustrates that tab 31 can be held within the thickness of poster 35, and that the extra thickness of tape 41 does not significantly decrease the capacity of a hanging rod or rods of a poster rack.

Figure 5:
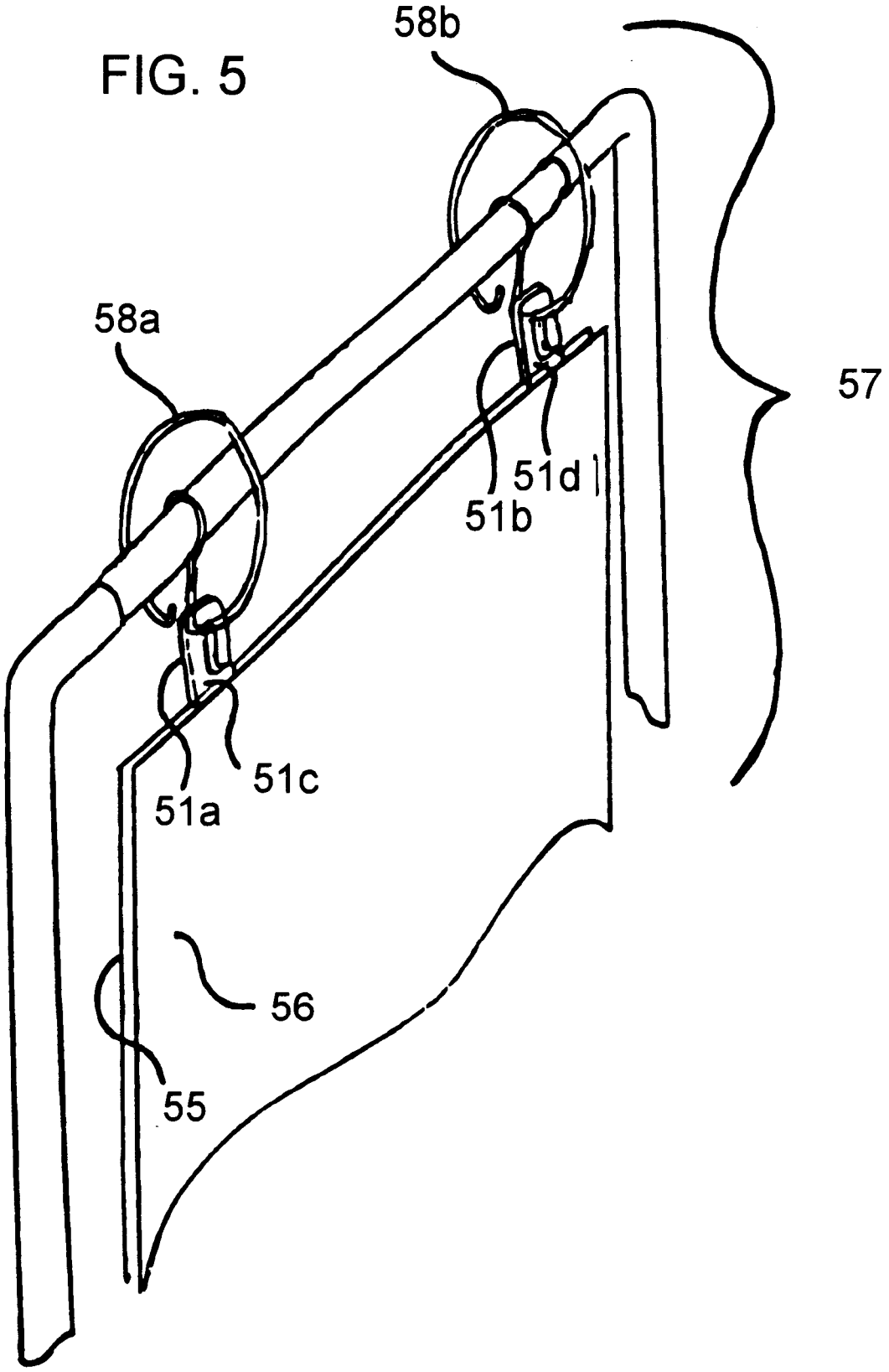
FIG. 5 is an illustration of the top portion a standard classroom rack for flip charts with two charts held by the flat plastic tabs of this invention hanging on the rings of the rack.

FIG. 5 is a view of the top portion a standard classroom rack 57 for flip charts. Two charts 55 and 56 held by flat plastic tabs 51*a* through 51*d* of this invention are hung on the rings 58*a* and 58*b* of rack 57. Chart 56 is in the front position, chart 55 is in the back position.

Figure 6:
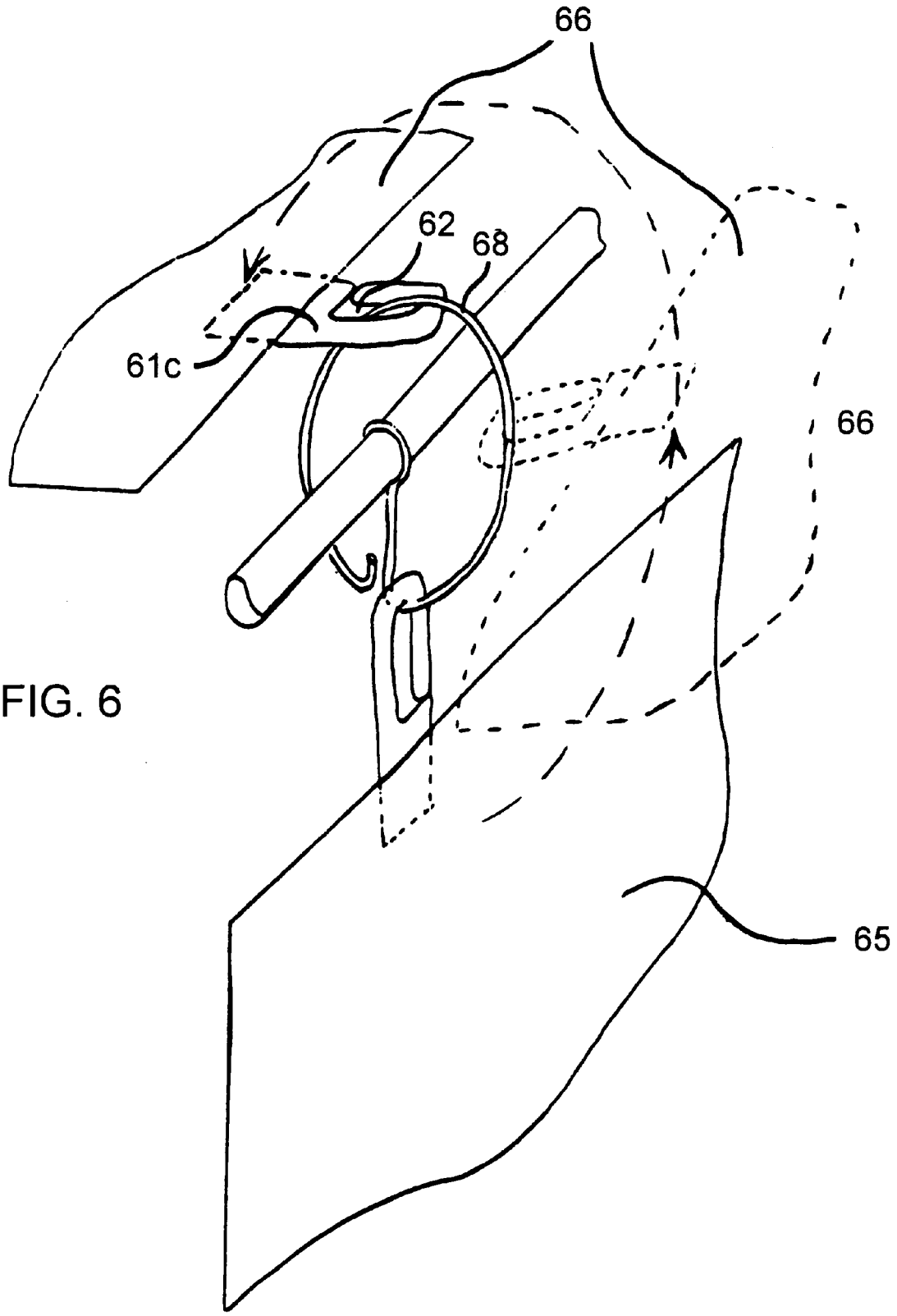
FIG. 6 is an illustration of the movement of the front chart held by a hook of this invention being flipped over the rack towards the back position.

FIG. 6 shows the movement of a front chart 66 held by hook 61*c* being flipped over the rack towards the back position. The elongated form of hole 62 provides room for movement along ring 68 avoiding binding friction even when hook 61*c* is angled tangentially in relationship to the ring 68.

Figure 7:
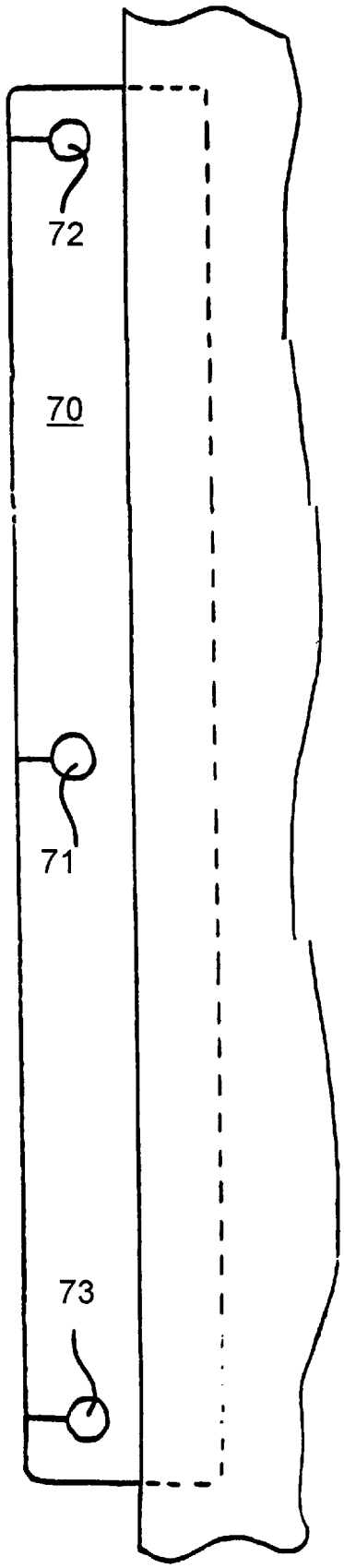
FIG. 7 is an illustration of a long tab with two alternative hole positions for use in combination with a single rod rack or a double rod rack.
Figure 8A:
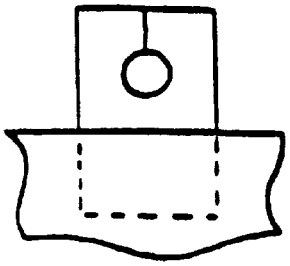
Figure 8B:
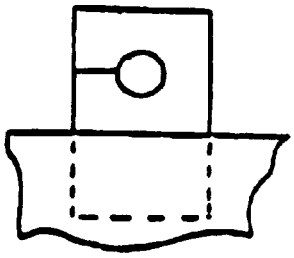
Figure 8C:
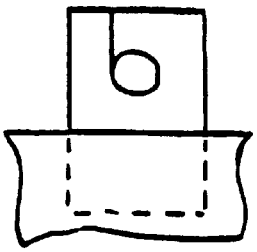
Figure 8D:
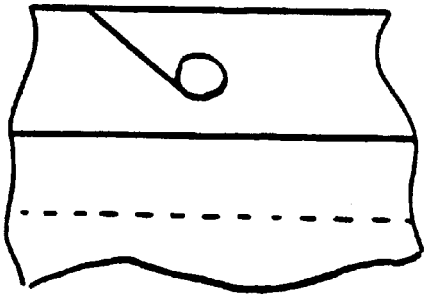
Figure 8E:
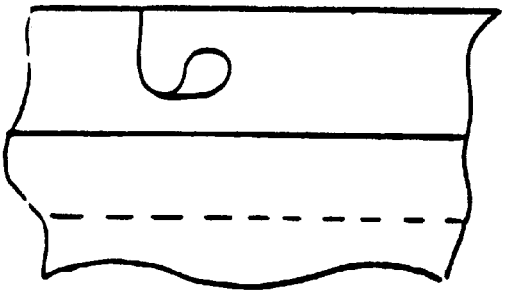

FIG. 7 shows a long tab 70 with two alternative hanging methods using three holes 71, 72, 73: one hole 7 in the center is a for single rod rack; two holes 71, 73 separated between their centers by 14" are provided for a double rod rack. The long tab 70 could be much longer to provide support for more flimsy materials such as thin paper or plastic bags.

FIGS. 8*a* through 8*e* are illustrations of alternative types of slits 81 through 85. Slits 82 through 85 could be more open slots, to the point of revealing a more traditional hook shape. Slit 81 could be a more open slot if it remains of lesser space than the supporting rod and to the extent that the material used were both flexible enough to allow the rod to pass, while rigid enough to provide support when hanging on the rod.

FIGS. 9*a* through 9*c* are illustrations of still other alternative types flip chart tabs 84 through 86 with slits 91 through 93 for flip charts 99*a* through 99*c*. The slot shape of the opening 97 is important to allow the tab to slide inclined tangentially to the ring as the chart is flipped over to the other side of the rack (as illustrated in FIG. 6). It was found that tab 95 is the most effective design allowing ease of placement and removal while still preventing accidental removal of the tab from a holding ring 58 (see FIG. 6).

FIG. 10 is an illustration of a centering device 100. A chart or poster 105 is shown face down, centered and held against alignment edge 101. Once poster 105 is centered, clips 103 hold the chart or poster 95 in position while tabs 111*a* and 111*b* are attached. One tab 111*a* has been attached by the simple addition of clear adhesive tape 104*a* attaching the tab 111*a* to the chart or poster 105. Another tab 111*b* with clear adhesive tape 104*b*, integrated during manufacture, is shown as the protective backing 107 is to be removed; tab 111*b* is to be positioned by placement to the guide notch 108 and the adhesive tape 104*b* applied to the back of the chart or poster 105.

A shown in FIGS. 1, 5 and 6 the objects to be hung for storage or for use as a flip chart can be hung on one or more rods or on rings. Rods and rings function as support hangers. The stile of the openings in the hanging tabs may be round for use on support rods, or may be elongated for use on either support rods or on support rings. In the later case, the elongated openings ease the flipping of the flip charts as disclosed with reference to FIG. 6.

FIG. 11 is an illustration of a storage rack and the associated mounting plate in selection position. The storage rack consists of a rectangular hanging frame 112, preferably made from round wire. In FIG. 11 there are shown 6 posters 113A through 113F hanging from rack frame 112 spaced apart for easy inspection. At the far end each side of rack frame 112 is bent by about 90° at bends 114, dividing frame 112 into an upper section 115 and a front section 118. Upper frame section 115 is provided to hanging frame 112 over hooks 116 of mounting plate 117*a*. As shown in FIG. 11 upper frame section 115 holds front section 118 in a substantially horizontal position, the selection position, for spreading apart stored posters 113A through 113F. Mounting plate 117*a* includes an extension 117*b* with a receiving hook 119. Hook 119 receives front end 120 of frame 112 to hold frame 112 and the stored objects in storage position as illustrated in FIG. 12. As is obvious from FIGS. 11 and 12 the storage rack of the present invention with the two positions, one for storing objects in a tight arrangement and a second position, the selection position for holding objects in a spread arrangement allows storage of many objects in a small space and allows to access individual objects without having to bend a stored object.

If a rack has to be moved, e.g. from the storage room to a classroom, it can easily be taken off hooks 116 and carried to another location were it can be mounted on a similar mounting plate.

Figure 13A:
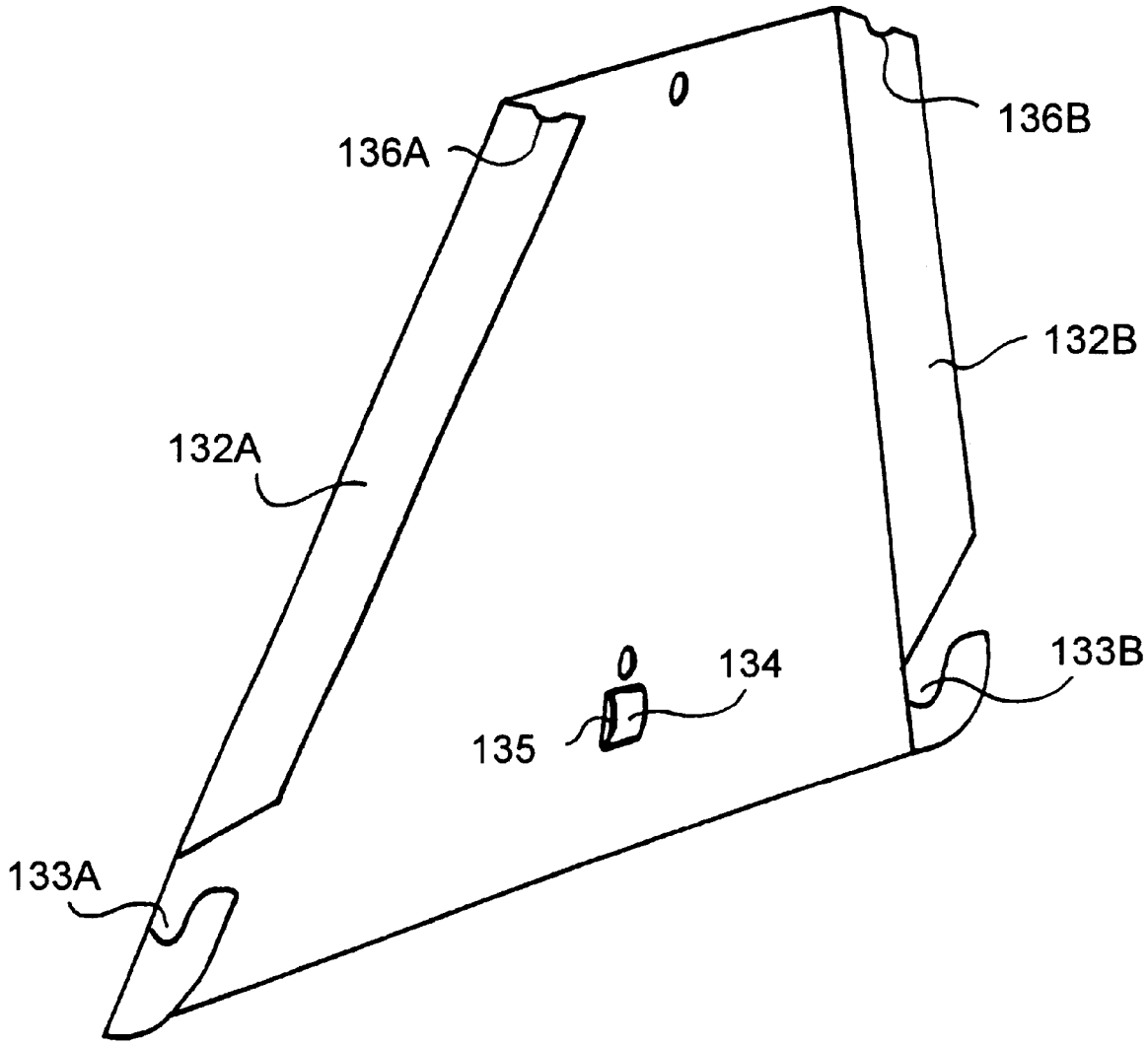
Figure 13B:
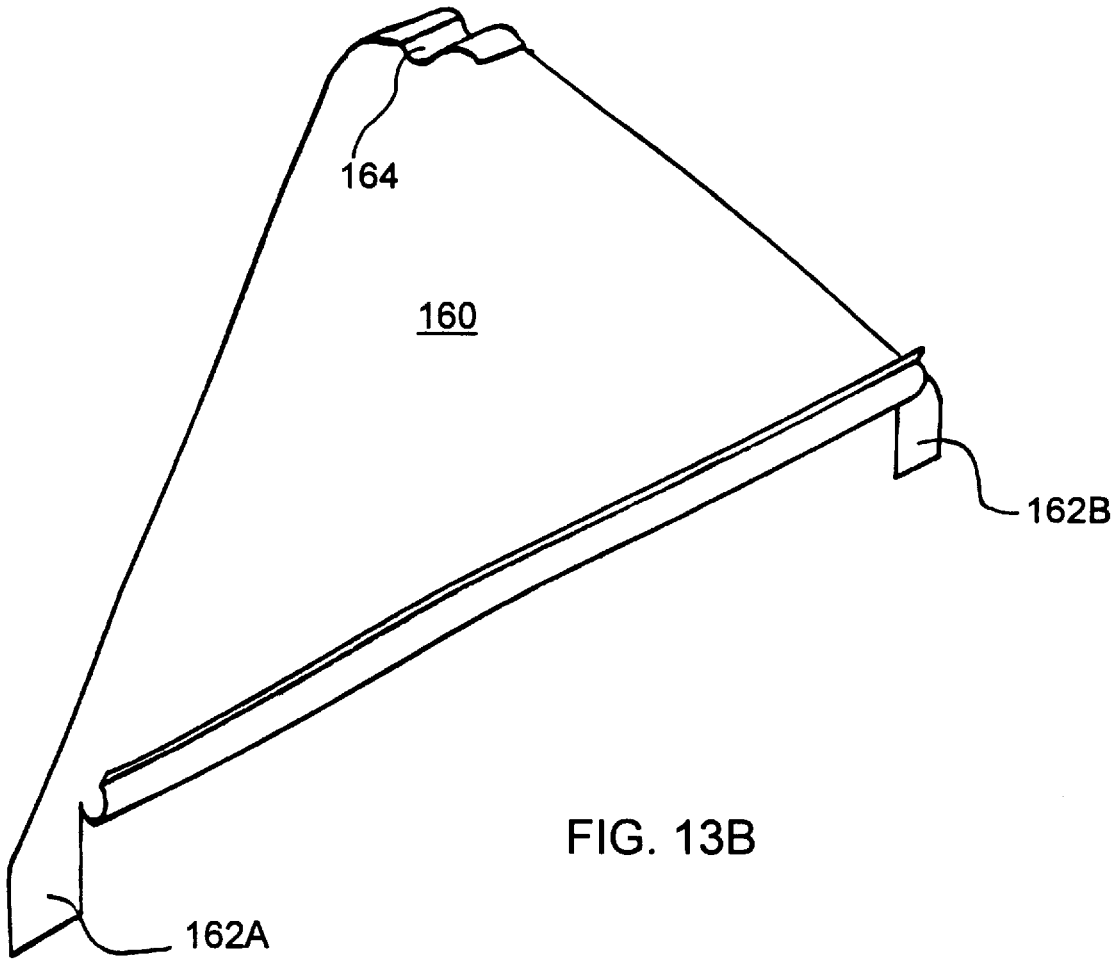

FIG. 13A through 13G are various implementations of the mounting plate for the storage rack of the present invention. FIG. 13A is an illustration of a mounting plate 131 for receiving a storage rack frame 112. It is made from sheet material, e.g. metal or plastic, with two sides 132A and 132B being bend forward. Each of the forwardly bent sides 132A and 132B include a notch 133A and 133B, respectively, for receiving an upper frame section 115 of a frame 112, see FIG. 11. An elastic protrusion 134 locks a frame 112 in position. In FIG. 13A protrusion 134 is shown as a flat leaf spring protruding through an opening 135 in mounting plate 131. However, other solutions using wire springs and being mounted on the front side of mounting plate 131 are considered to be within the scope of the present invention. At the upper end of bent sides 132A and 132B there is each one notch 136A and 136B, respectively, for receiving front end 120 of a frame 112, see FIG. 12, to hold the frame 120 in storage position. Mounting plate 131 can be attached to any substantially vertical wall or to a stand or upright.

Wall plate 160 (FIG. 13B) has a 180° round bend 161 at the lower end and a hook 164 at the upper end. Bend 161 receives end section 115 of a frame 112. Hook 164 receives section 120 of a frame 112, when frame 112 is in storage position. A leaf spring 166 is provided to retain section 115 inside bend 161, unless overridden by forcefully moving section 115 out of bend 161. Straight straps 162*a* and 162*b* serve as stops for frame 120 when front section 118 is in horizontal position.

Figure 13C:
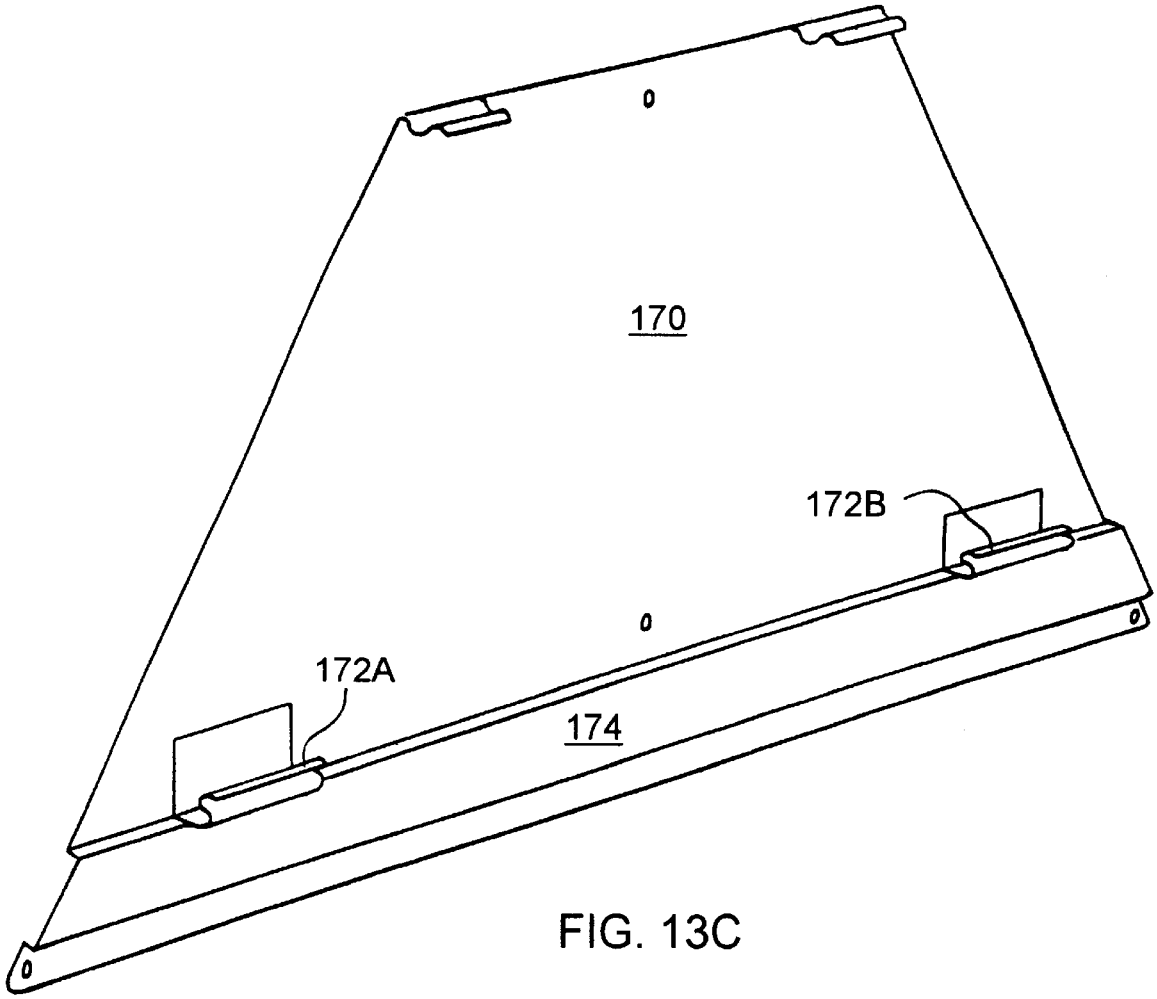
Figure 13D:
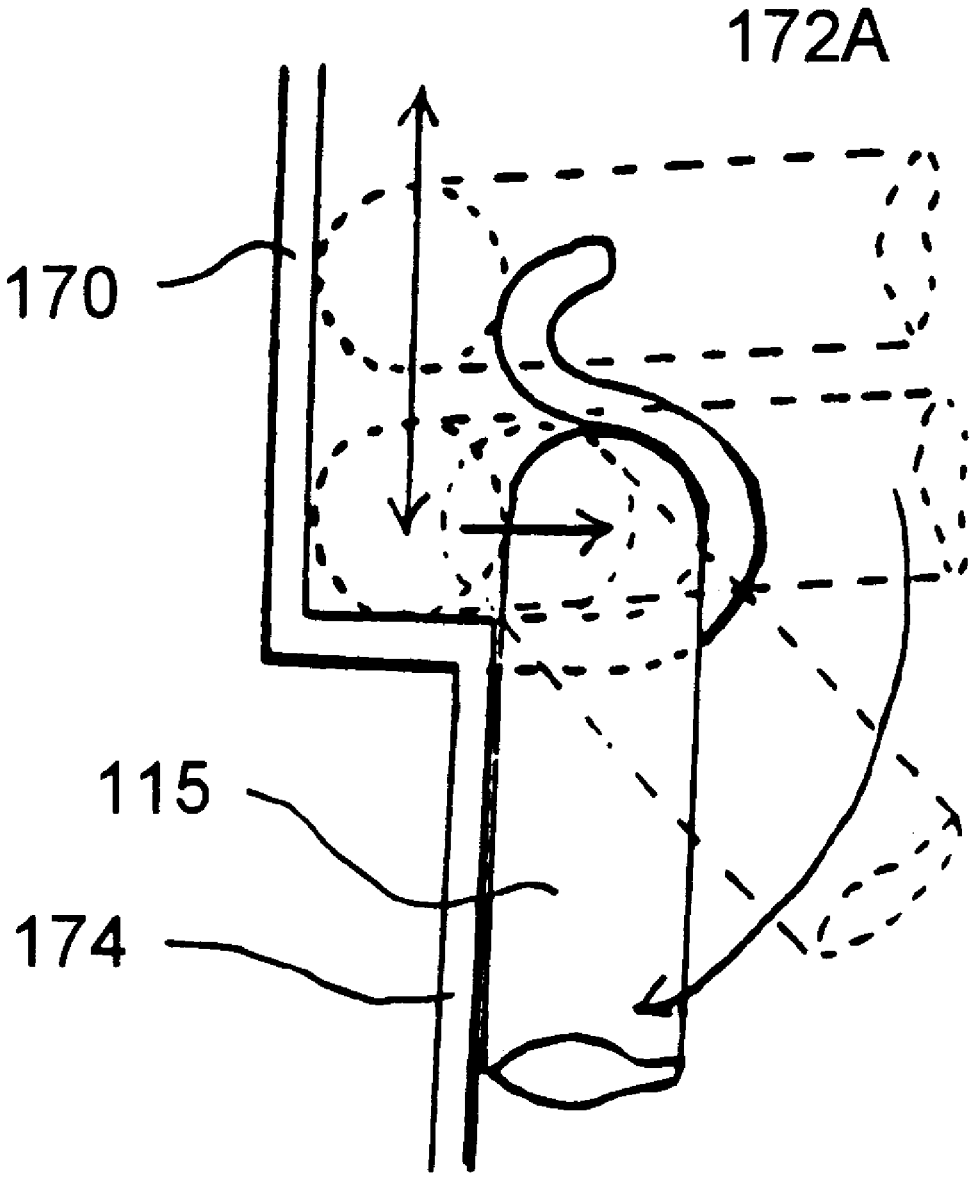

FIG. 13C is another design of a wall plate. Wall plate 170 has two lower hooks 172A and 172B. Below hooks 172A and 172B there is a forward bent section 174 of wall plate 170. This section, as can be seen in more detail in FIG. 13D ensures that frame section 115 of a frame 120 is locked on hooks 172A and 172B when in selection position. A frame 120 is inserted into hooks 172A and 172B with front section 118 in upright position, section 115 in horizontal position (see also FIGS. 11 and 12). Hooks 173A and 173B are provided for receiving front end section 120 to hold frame 112 in storage position.

Figure 13E:
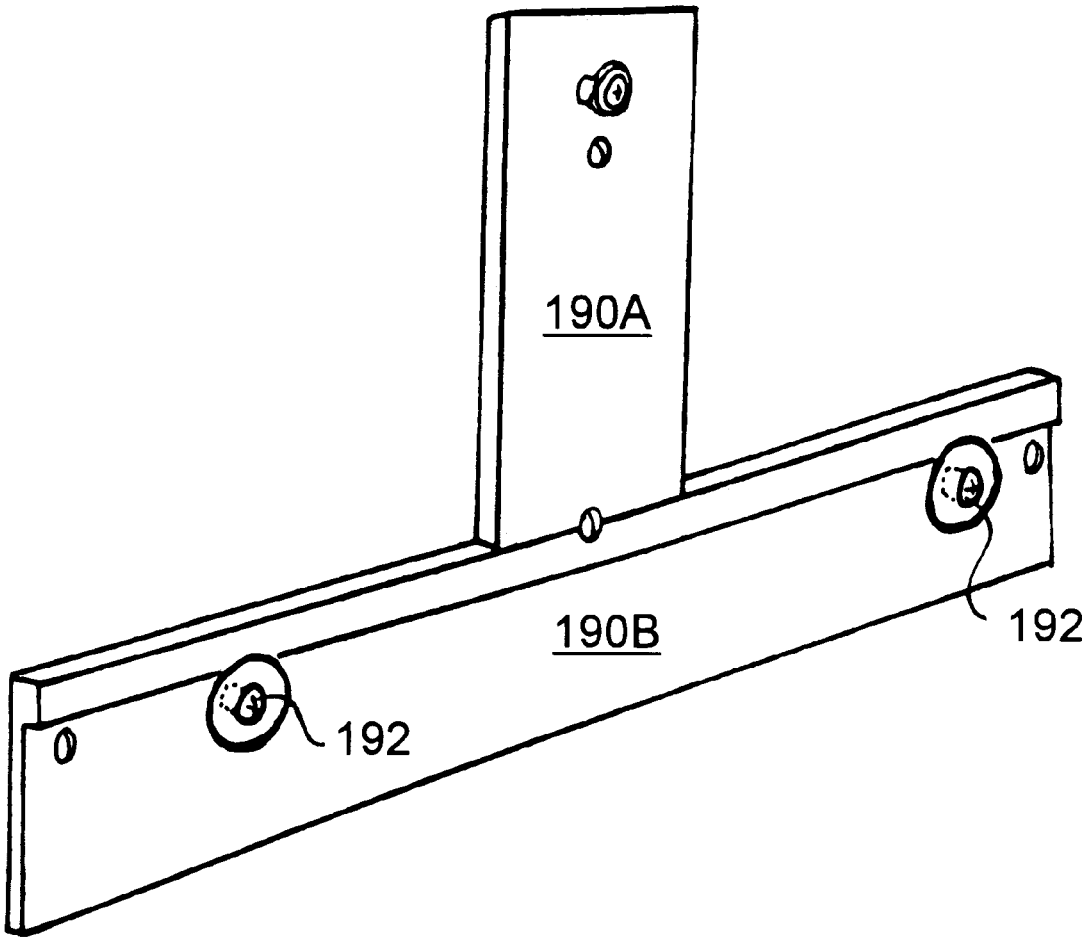
Figure 13F:
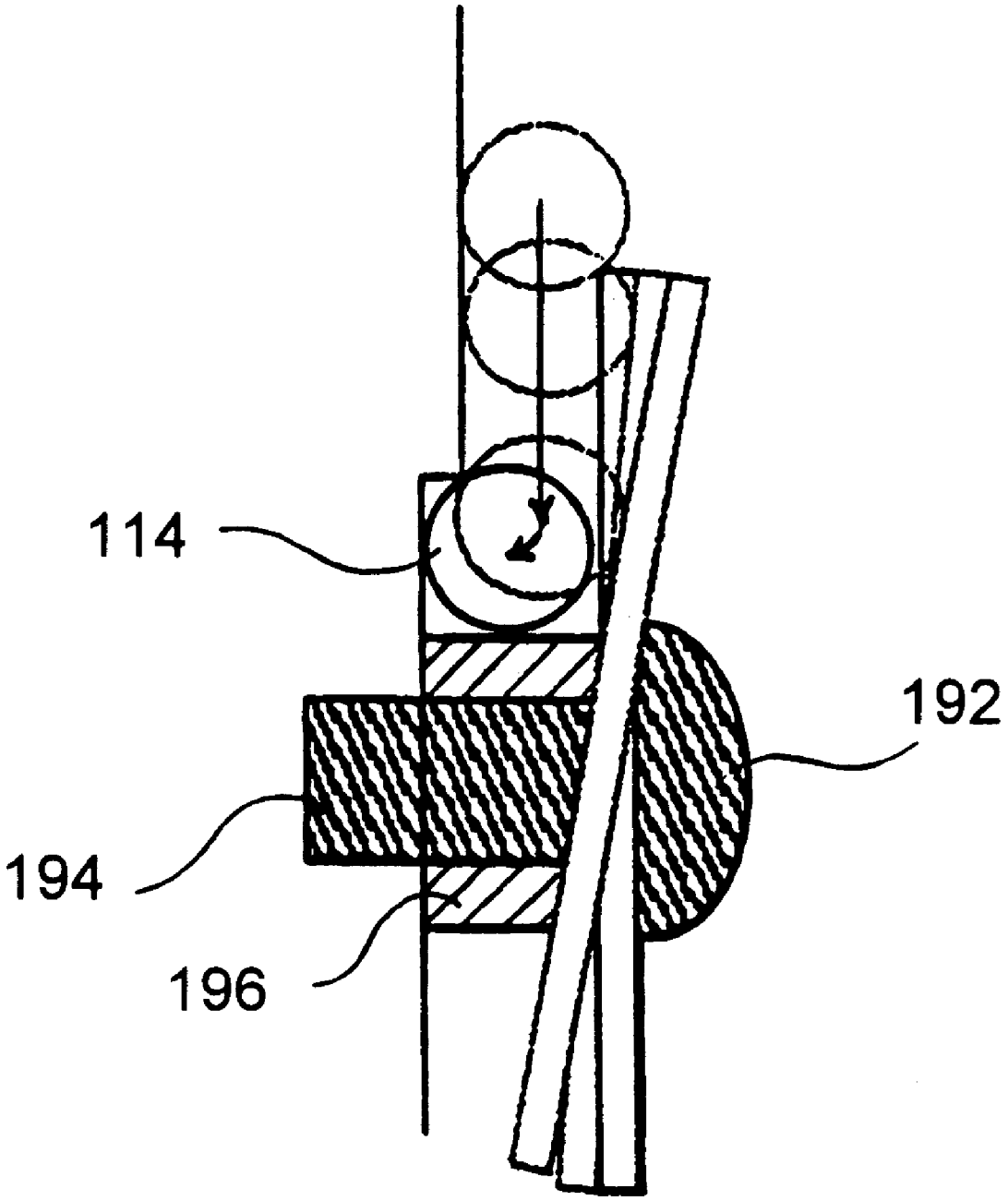

FIG. 13E is an illustration of a mounting plate. Mounting plate 190 is similar to mounting plate 117 of FIG. 11. However, instead of having hooks 116 this mounting plate 190 has two bolts 192 anchored in section 190B. On shaft 194 (see FIG. 13F) of each bolt 192 there is an elastic piece 196, tubing or compression spring, and between head 195 and elastic piece 196 there is a large washer 193. Along the upper end of section 190B thickness of the section is increased at a distance from elastic pieces 196 on bolts 194 to lock wire section 114 as shown in FIG. 13F. The distance depends on the thickness of section 114 of a frame 120.

Figure 13G:
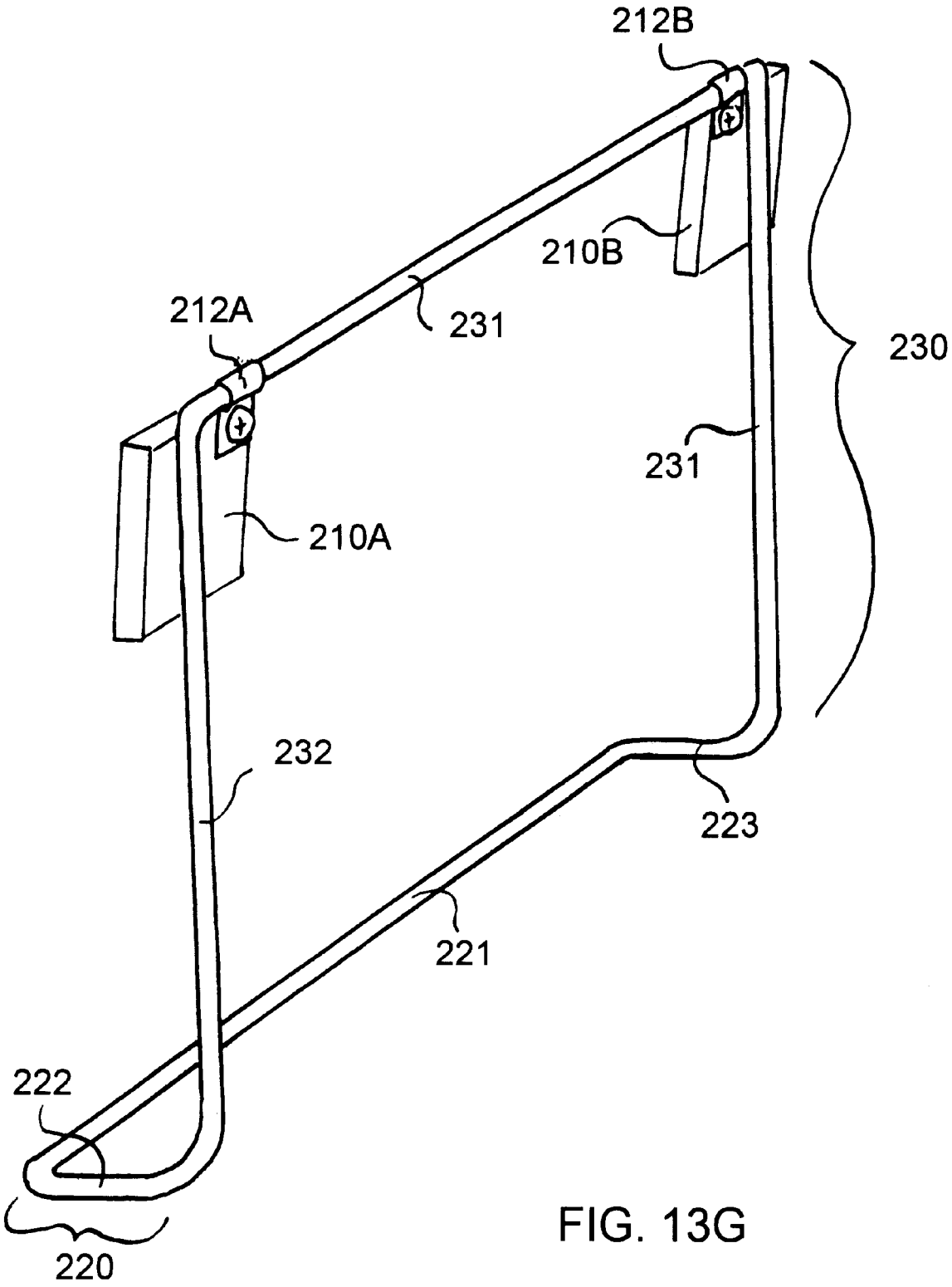
Figure 13H:
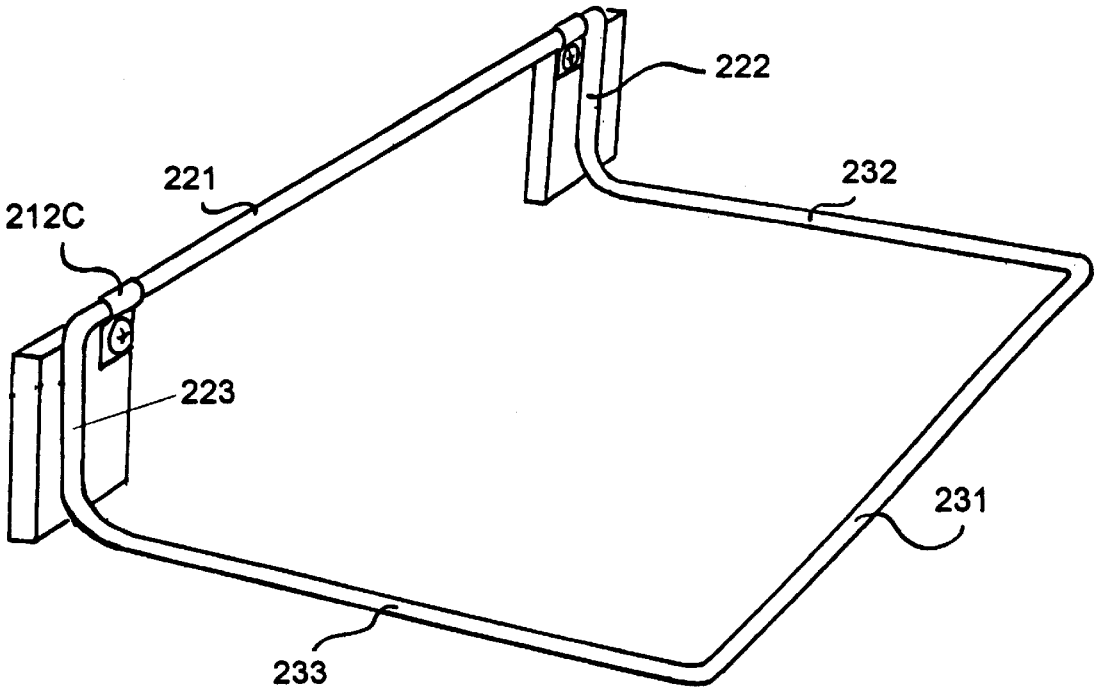

A mounting facility may consist of a single mounting plate, as illustrated in FIGS. 13A, 13B, 13C and 13E or two or more mounting plates. A set of two mounting plates and the manner of using the storage frame is shown in FIGS. 13G and 13H. Each such mounting plate has a sturdy hook 212A and 212B, respectively, for receiving front end section 231 (see FIG. 13G), or back end section 221 (see FIG. 13H). Mounting plates 210A and 210B may be mirror images of each other, as shown in FIG. 13G, or they may be symmetrical.

FIG. 13G is an illustration of holding frame 201 of the present invention in a poster storage position using two simple mounting plates 210A and 210B. (Posters not shown).

FIG. 13H is an illustration of holding frame 201 of the present invention in a poster selection position using two simple mounting plates 210A and 210B. (Posters not shown).

Frame 201 consists of a short frame section 220 and a long frame section 230. Short frame section 220 has a back end section 221 and two side bars 222 and 223. Long frame section 230 has a front end section 231 and two side bars 232 and 233. Side bars 222 and 223 are connected with side bars 232 and 233, respectively, under an angle of about 90°. The connecting bars between side bars are curved to allow unimparred sliding of stored objects from one frame section to another. Best sliding characteristics are achieved if the connecting curved sections have an outside radius which is larger than the thickness of the side sections plus the extension of a tab above the side section.

The material frame 201 is made of is of sufficient strength for carrying it with attached sheets of graphics or the like and for attach it to a mounting facility with either one of end sections 221 or 231 in a storing position or a selection position, respectively.

FIG. 14 is an illustration of another implementation of a poster holding frame, in which the straight long section 230 of the holding frame 201 of FIGS. 13G and 13H is replaced by a semicircular section. Poster holding frame 240 consists of a short frame section 242 and a semicircular frame section 244. Short frame section 242 has a back end section 246 and two side bars 247 and 248. Side bars 247 and 248 are connected with the open ends of semicircular 244 under an angle of about 90°. The connecting curved bars between short frame section 242 and semicircular section 244 allow sliding stored sheets from one frame section to another. The curvature depends on the size of the holes or openings in the tabs and the height of the hanging tabs above the frame (see also FIGS. 6 through 9).

As can be recognized from FIG. 14, poster holding frame 240 is most useful when handling posters or the like being suspended from a single tab. Posters can be inspected for selection, separated or rearrangement by sliding them back and forth while the holding frame is in selection position. In storage position holding frame 240 has two sections 247 and 248 for tightly holding stored posters or the like. This allows to hold stored posters in two groups.

FIG. 15A–15D are illustrations of various cross-sections of the side bars and curved sections, the suspension bars of holding frames disclosed in this specification. These suspension bars are the parts of a holding frame, from which the sheetlike objects are suspended or on which the suspension tabs slide between storage position and selection position and during the selection process. The end bars and crossbars of a holding frame may have a different cross-section.

Figure 15A:
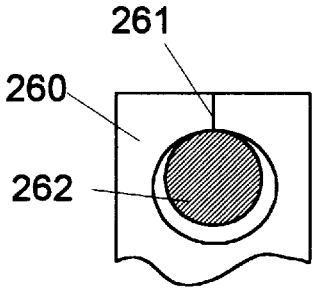
Figure 15B:
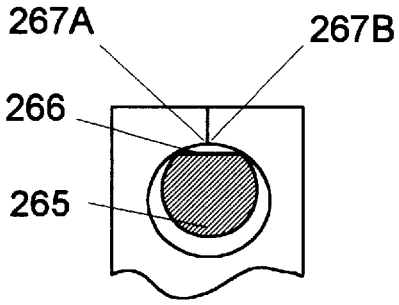
Figure 15C:
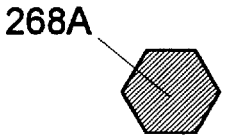
Figure 15D:
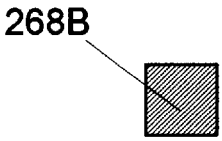
Figure 15E:
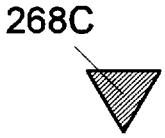

FIG. 15A illustrates how a suspension tab 260 with an opening slit 261 rides on a suspension bar 262, which has a circular cross-section. However, it has been found, that when using suspension tabs with a slit as shown in FIGS. 2 and 15A, where the slit is at the top of the suspension tab, it increases holding strength of the tab to use suspension bars with a flat top side, as illustrated in FIGS. 15B and 15C. In FIG. 15B suspension bar 265 has a flat top surface 266. The lower corners 267A and 267B do not touch suspension bar 265 and, for that reason, less propensity to be bent outward while suspended on bar 265. Outwardly bent corners 267A and 267B are less likely to result in an unintended release of the suspended object from suspension bar 265.

FIGS. 15B–15E are illustrations of other cross-sections of suspension bars with flat top surfaces 268A–268C. Such flat top bars are less likely than a round suspension bar, such as bar 262 to open a slit of a suspension tab causing a undesired release of a moving sheetlike object from the hanging frame.

FIGS. 16A–16D are illustrations of a family of holding means, holding sticks and holding frames, for sheetlike objects, such as posters and the like, having one or more suspension tabs or having a long suspension tab with one or more openings. In FIG. 1 each of the sheetlike objects have two suspension tabs. In FIG. 3 the sheetlike object has a long suspension tab with one opening. FIG. 7 is an illustration of a long suspension tab with three opening attached to a sheetlike object. The width of the tabs, the number of tabs and the number of openings in a long tab depends on the width of the sheetlike object and the need to prevent it from folding. Wide and soft sheetlike object may require multiple tabs or long tabs with multiple openings.

The family of holding frames illustrated in FIGS. 16A–16D satisfies these requirements. Basic to these holding frames is a single holding stick (see FIG. 16A) for sheetlike objects having one suspension tab with one centered opening. It has a first section and a second section which are linked by a curved section. The free ends of the first section and the second section each have a crossbar for attaching the holding stick to some mounting means, such as a mounting plate with hooks. The crossbar has to provide for stable suspension from the holding means. The length of the crossbar depends on the mounting means, which may be two hooks on a mounting plate as illustrated in FIGS. 11, 13A, 13C, 13E, 13G, whereby the horizontal space between the mounting hooks can be as small as the width of the diameter of the frame members, as illustrated in FIG. 19A.

Interconnecting crossbars at the storage position of two holding sticks provides for an open holding frame (FIG. 16B) for sheetlike objects with either two tabs with each one opening, or a long tab with two openings. The interconnected short crossbars become an end bar of the holding frame. Interconnecting both sets of crossbars provides for a closed holding frame (FIG. 17A) for sheetlike objects with either two tabs with each one opening, or a long tab with two openings. Interconnected crossbars become end bars of the holding frame. FIG. 16C is an illustration of an open holding frame where crossbars at the storage position of three holding sticks are interconnected providing an open holding frame for sheetlike objects with either three tabs having each one opening, or one long tab with three openings. Correspondingly, interconnection both sets of crossbars provides for a closed holding frame (FIG. 17B) for sheetlike objects with either three tabs with each one opening, or a long tab with three openings. FIGS. 16D and 17C are illustration of open and closed holding frames for sheetlike objects with either four tabs having each one opening, or one long tab with four openings.

FIGS. 18A–18G are illustrations of holding frames with two storage sections. The two storage sections and the selection section form a broad-based U-shaped figure. Adding a second storage section allows to view selectively front side or back side of the suspended sheetlike objects, in storage position as well as in selection position.

Figure 16A:
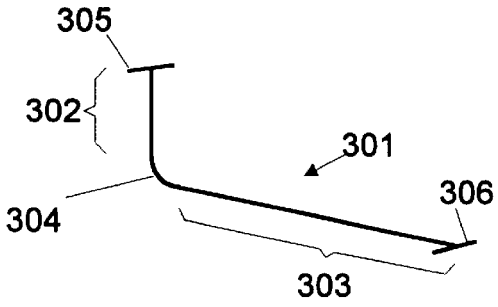

FIG. 16A is an illustration of a holding stick from which sheetlike objects with a single suspension tab can be suspended. Holding stick 301 has a first, storage section 302 and a second, selection section 303. Storage section 302 and selection section 303 are connected by curved section 304. The free ends of storage section 302 and selection section 303 are terminated by end bars 305 and 306. End bars 305 and 306 prevent any object suspended from holding stick 301 from sliding off, and they are used for holding stick 301 in a mounting fixture as illustrated in FIG. 19B.

Figure 16B:
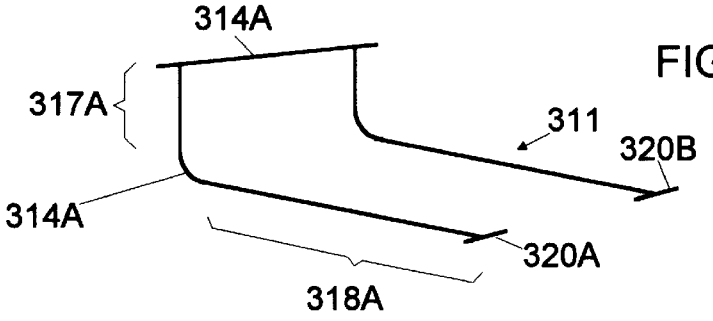
Figure 16C:
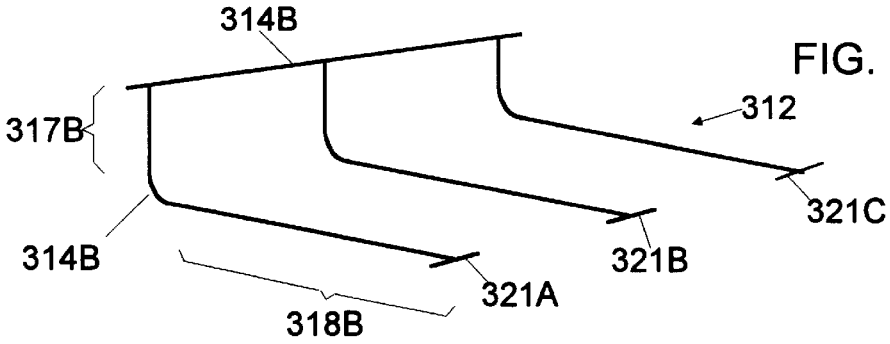
Figure 16D:
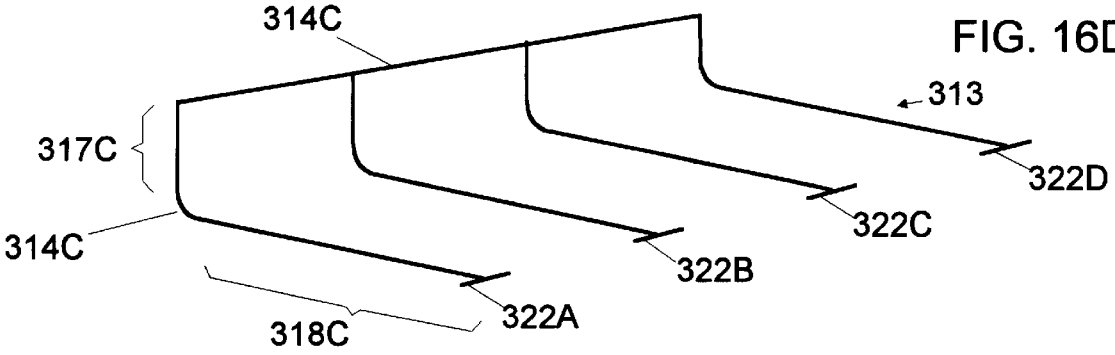

FIGS. 16B–16D are illustrations of open holding frames 311, 312, and 313 for objects having two, three, and four tabs, respectively. Each of these holding frames 311, 312, and 313 exhibit at their storage sections 317A–317C an end bar 314A, 314B, and 314C, respectively, while each of the suspension bars is terminated at the free end of the selection sections 318A–318C by a short end bar: end bars 320A and 320B in FIG. 16B, end bars 321A–321C in FIG. 16C, and end bars 322A–322D in FIG. 16D. An end bar at a storage section may have free ends extending beyond the width of the holding frame, as illustrated in FIGS. 16B and 16C (end bars 314A and 314B, respectively), in comparison with end bar 314C of FIG. 16D. Storage sections 317A–317C and selection sections 318A–318C are linked by curved sections 314A–314C, respectively.

FIGS. 17A–17C are illustrations of closed holding frames for sheetlike objects having two or more suspension tabs. Closed holding frames for sheetlike object with two suspension tabs have already been discussed with respect to FIGS. 11, 12, 13G, and 13H. Wide sheetlike objects may have three or more suspension tabs requiring holding frames with three and more suspension bars.

Closed holding frames provide for a higher stability than open holding frames. Like corresponding open holding frames 311–313 of FIGS. 16B–16D closed holding frames 331–333 each have a storage position 334A–334C, a selection position 335A–335C, respectively. Corresponding storage positions 334A–334C and selection positions 335A–335C are connected by two, three and four curved sections 336A, 336B, and 336C, respectively. As illustrated in FIGS. 17A–17C, end bars 335A–335C and 336A–336C can extend beyond the width of the holding frame for an improved support of suspension tabs being in adjacent to such an end bar.

FIGS. 18A–18D and 18E–18G are illustrations of open holding frames and closed holding frames with two storage sections for sheetlike objects having one or more suspension tabs, respectively.

Figure 18A:
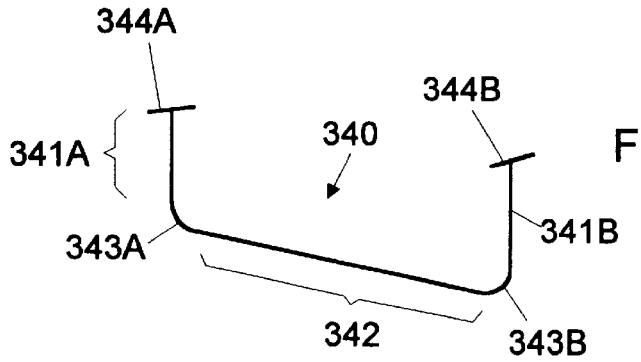

FIG. 18A is an illustration of a suspension stick 340 with two storage section 341A and 342A, a selection section 342. Storage sections 341A and 342A are connected to selection section 342 by curved section 343A and 343B, respectively. The free end of storage sections 341A and 342A are terminated by cross bars 344A and 344B, respectively. Cross bars 344A and 344B prevent stored objects from sliding off and are used to suspend the stick from a mounting plate in either one of two selection positions or in either one of two storage positions.

Figure 18B:
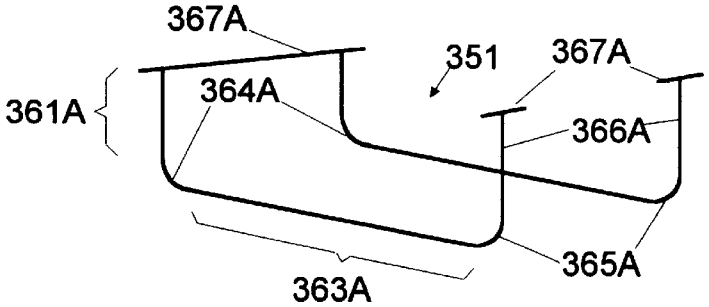
Figure 18C:
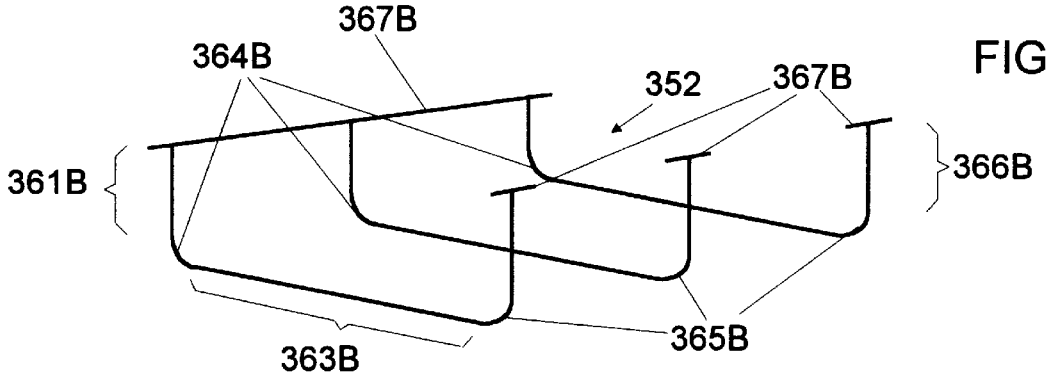
Figure 18D:
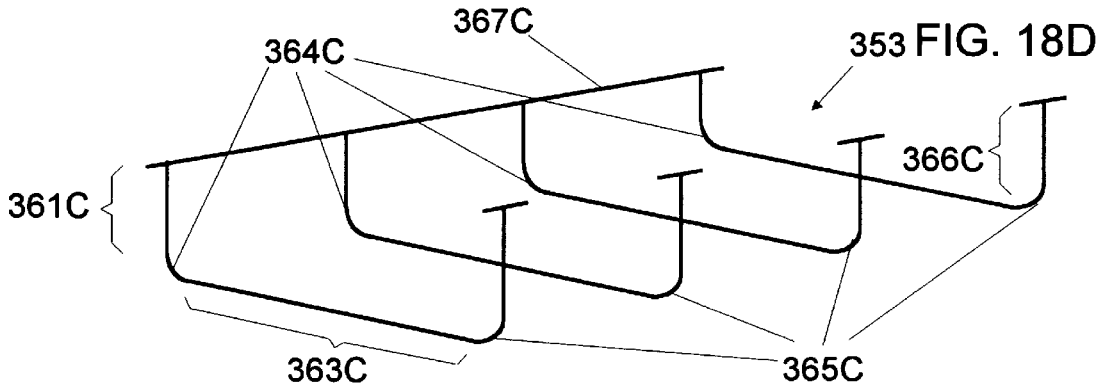

FIGS. 18B–18D are illustrations of open holding frames 351–353 with each two storage sections 361A and 366A, 361B and 366B, and 361C and 366C, a selection section 363A, 363B and 363C and two interconnecting curved sections 364A and 365A, 364B and 365B, and 364C and 365C, respectively. As illustrated in FIGS. 18B–18D, end bars 367A–367C can extend beyond the width of the holding frame for an improved support of suspension tabs being in adjacent to such an end bar.

Figure 18E:
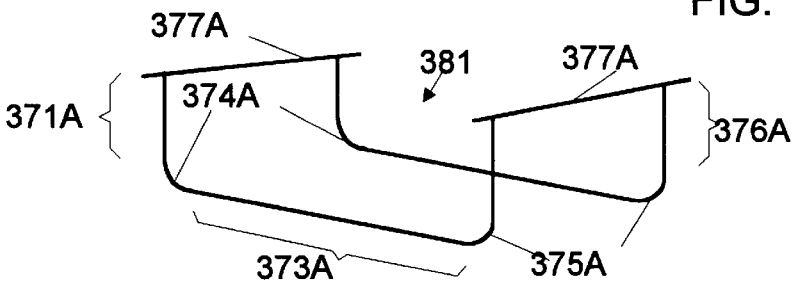
Figure 18F:
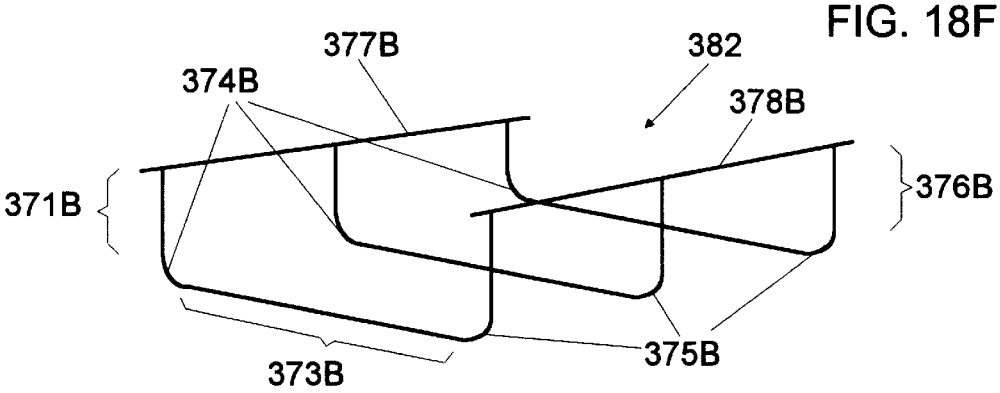
Figure 18G:
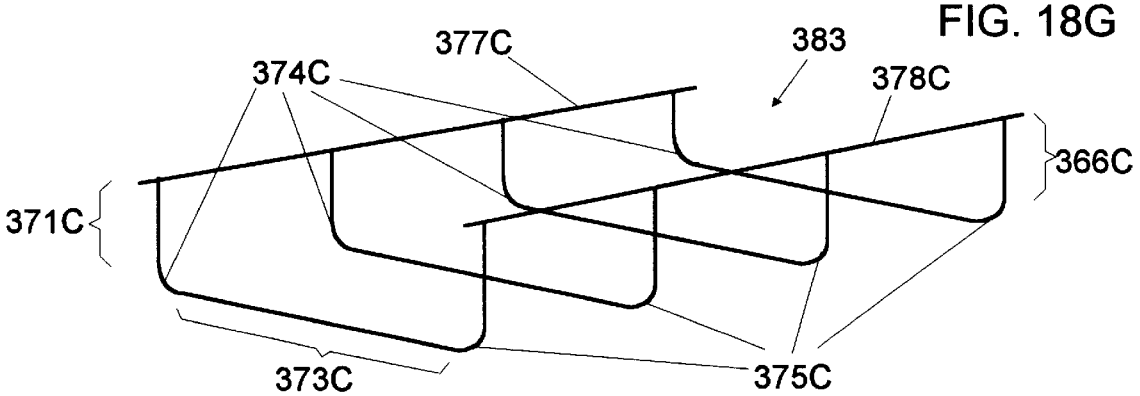

FIGS. 18E–18G are illustrations of open holding frames 380–383 with each two storage sections 371A and 376A, 371B and 376B, and 371C and 376C, a selection section 373A, 373B and 373C and two interconnecting curved sections 374A and 375A, 374B and 375B, and 374C and 375C, respectively. As illustrated in FIGS. 18B–18D, end bars 377A–377C and 378A–378C can extend beyond the width of the holding frame for an improved support of suspension tabs being in adjacent to such an end bar.

FIGS. 19A and 19B are illustrations of how a holding stick and an open holding frame are held in selection position using one or two mounting plates, respectively. In FIG. 19A single holding plate 400 has two holding clips 401. Holding clips 401 include open shells 402 which allow to insert an end bar 403 of a holding stick 404. In FIG. 19B end bar 410 of an open holding frame 411 is held in holding clips 412 and 413 of mounting plates 414 and 415, respectively.

In similar fashions other open and close mounting frames with one or two storage sections can be mounted on dual clip mounting plates. The same holding plate can be used in combination with any of the open and closed holding frames illustrated in FIGS. 16B–16D and 17A–17C.

Figure 20A:
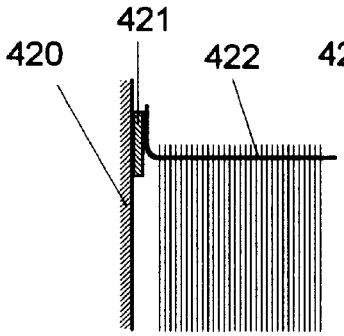
Figure 20B:
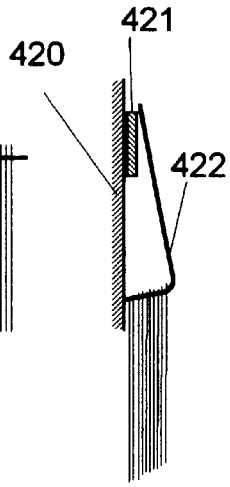
Figure 20C:
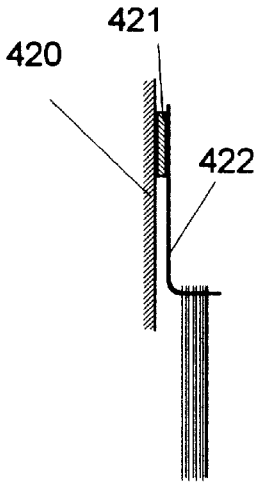

FIGS. 20A–20E are schematic illustrations of the various mounting possibilities for holding sticks, and for open and closed holding frames with on or two storage sections. In FIG. 20A a holding stick, an open or a closed holding frame 422 is attached in selection position to a mounting plate 421, which is attached to wall 420. Stored sheetlike objects can be spread over the length of the horizontal selection section of holding stick, an open or a closed holding frame 422. In FIG. 20B holding stick, an open or a closed holding frame 422 is attached to mounting plate 421 in one storage position, and in FIG. 20C holding stick, open or closed holding frame 422 is attached to mounting plate 421 in a different storage position. The two storage positions allow to see front or back side of the stored sheetlike objects.

Figure 20D:
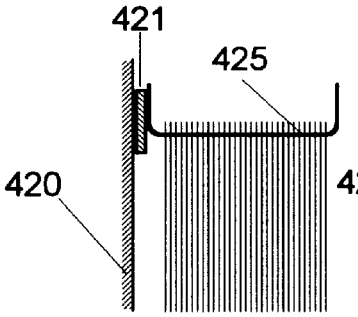
Figure 20E:
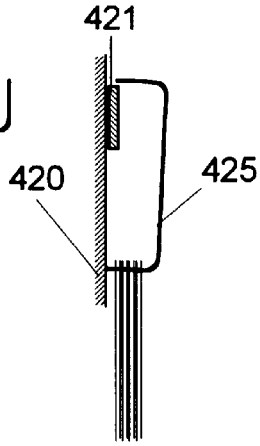

In FIG. 20D an open or a closed holding frame 425 with two storage sections is attached in one of two selection positions to a mounting plate 421, which is attached to wall 420. Using one or the other storage section for attaching holding frame 425 to holding plate 421 allows to view front or back sides of the stored objects. Stored sheetlike objects can be spread over the length of the horizontal selection section of open or a closed holding frame 425. In FIG. 20E open or closed holding frame 425 is attached to mounting plate 421 in one of two storage position, which, again, allows to view front or back side of the stored objects.

FIG. 21 is a illustration of a curved section and a tab. Curved section 431 is part of section of a holding stick or holding frame 430 and has an inner radius 432. At the horizontal section of frame 430 there is an overlay sketch of a hanging tab 434 and the cross-section of frame 430. In this example, the frame sections have a flat top cross-section 436. Slit 440 is free and does not ride on the frame section. It has been found, that for a smooth transition of tabs of stored objects between a storage section and a selection section of a hanging frame or hanging stick via a curved section 431, height 442 between the top end of tab 434 and top 433 of the frame sections should not exceed 1.25 times the inner radius 432. For thick, stiff tabs height 442 should be less.

It is understood that it is within the skills of the artisan to substitute the disclosed end bar-hook interface between holding stick/frame and mounting plate with differently configured means performing the same function of easily receiving a holding frame design mounting plates with additional features such as artistic features to incorporate a mounting plate into a styled piece of furniture, or to add means to perform additional functions, e.g. protect a stored set of objects from dust.

What I claim is:

1. A support device for hanging a plurality of sheetlike objects using hanging tabs, comprising a mounting plate, a holding stick having a first straight section including a first end and a second end, a second straight section including a third end and a fourth end and a curved section interconnecting said second end and said third end under an angle, said first straight section, said second straight section and said curved section defining a plane, said curved section and said straight sections having the same cross-section, a first end bar attached to said first end substantially normal to said plane, and a second end bar attached to said fourth end substantially normal to said plane, said first straight section being shorter than said second straight section, said mounting plate including at least one hook for receiving selectively one of said end bars, thereby providing for mounting said hanging stick in at least one storage position and one selection position, a plurality of said hanging tabs each of said plurality of hanging tabs having an opening and a slit from a perimeter of said hanging tab to said opening for mounting and dismounting said hanging tab on said holding stick, and means for attaching the hanging tab to one of said sheetlike objects.

2. A support device for hanging a plurality of sheetlike objects, as claimed in claim 1, wherein said angle is about 90°.

3. A support device for hanging a plurality of sheetlike objects using hanging tabs, as claimed in claim 1, wherein said holding stick comprises a first straight section including a first end and a second end, a second straight section including a third end and a fourth end, a third straight section including a fifth end and a sixth end, a first curved section interconnecting said second end and said third end at an angle, and a second curved section interconnecting said fourth end and said fifth end at said angle, said first, second and third straight sections, and said first and second curved section defining a plane, and forming a U-shaped figure, said first and third straight sections being shorter than said second straight section, said second end bar being attached to said sixth end substantially normal to said plane, said mounting plate providing for mounting said hanging stick in at least one storage position and at least one selection position.

4. A support device for hanging a plurality of sheetlike objects, as claimed in claim 3, wherein said cross-section has a flat top surface.

5. A support device for hanging a plurality of sheetlike objects, as claimed in claim 3, wherein said angle is about 90°.

6. A support device for hanging a plurality of sheetlike objects, as claimed in claim 3, wherein said cross-section has a flat top surface.

7. A support device for hanging a plurality of sheetlike objects using hanging tabs, comprising a plurality of mounting plates, a holding frame including a plurality of holding sticks, each of said holding sticks having a first straight section including a first end and a second end, a second straight section including a third end and a fourth end and a curved section interconnecting said second end and said third end under an angle, said first straight section, said second straight section and said curved section defining a plane, said curved section and said straight sections having the same cross-section, said first straight section being shorter than said second straight section;

each one of said first or fourth ends including a first end bar substantially normal to said planes of said holding sticks, a second end bar attached to the other one of said first or fourth ends substantially normal to said planes of said holding sticks, said plurality of mounting plates each including at least one hook for receiving selectively either said first end bars or said second end bar, thereby providing for mounting said hanging frame in at least one storage position and one selection position, a plurality of said hanging tabs each of said plurality of hanging tabs having an opening and a slit from a perimeter of said hanging tab to said opening for mounting and dismounting said hanging tab on one of said straight and curved sections of said support device, and means for attaching the hanging tab to one of said sheetlike objects.

8. A support device for hanging a plurality of sheetlike objects, as claimed in claim 7, wherein said angle is about 90°.

9. A support device for hanging a plurality of sheetlike objects, as claimed in claim 7, wherein said cross-section has a flat top surface.

10. A support device for hanging a plurality of sheetlike objects as claimed in claim 7, wherein said holding frame includes a plurality of holding sticks, each of said holding sticks having a first straight section including a first end and a second end, a second straight section including a third end and a fourth end, a third straight section including a fifth end and a sixth end, a first curved section interconnecting said second end and said third end under an angle, and a second curved section interconnecting said fourth end and said fifth end under said angle, said first, second and third straight sections, and said first and second curved section defining a plane, and forming a U-shaped figure, said curved section and said straight sections having the same cross-section, said first and third straight sections being shorter than said second straight section, each one of said first or sixth ends including a first end bar substantially normal to said planes of said holding sticks, a second end bar attached to the other one of said first or sixth ends substantially normal to said planes of said holding sticks, said mounting plate providing for mounting said support device in at least one storage position and at least one selection position.

11. A support device for hanging a plurality of sheetlike objects, as claimed in claim 10, wherein said angle is about 90°.

12. A support device for hanging a plurality of sheetlike objects, as claimed in claim 10, wherein said cross-section has a flat top surface.

13. A support device for hanging a plurality of sheetlike objects using hanging tabs, comprising a plurality of mounting plates, a holding frame including a plurality of holding sticks each of said holding sticks having a first straight section with a first end and a second end, a second straight section with a third end and a fourth end and a curved section interconnecting said second end with said third end under an angle, said first straight section, said second straight section and said curved section defining a plane, said curved section and said straight section having the same cross-section, said first straight section being shorter than said second straight section;

said first ends of said plurality of holding sticks being connected by a first end bar, said fourth ends of said plurality of holding sticks being connected by a second end bar, said plurality of mounting plates each including at least one hook for receiving selectively one of said first end bar and said second end bar, thereby providing for mounting said hanging frame in at least one storage position and one selection position, a plurality of said hanging tabs each of said plurality of hanging tabs having an opening and a slit from a perimeter of said hanging tab to said opening for mounting and dismounting said hanging tab on one of said straight and curved sections of said support device, and means for attaching the hanging tab to one of said sheetlike objects.

14. A support device for hanging a plurality of sheetlike objects, as claimed in claim 13, wherein said angle is about 90°.

15. A support device for hanging a plurality of sheetlike objects, as claimed in claim 13, wherein said cross-section has a flat top surface.

16. A support device for hanging a plurality of sheetlike objects as claimed in claim 13, wherein said holding frame includes a plurality of holding sticks each of said holding stick having a first straight section including a first end and a second end, a second straight section including a third end and a fourth end, a third straight section including a fifth end and a sixth end, a first curved section interconnecting said second end and said third end under an angle, and a second curved section interconnecting said fourth end and said fifth end under said angle, said first, second and third straight sections, and said first and second curved section of holding stick defining a plane, and forming a U-shaped figure, said curved section and said straight sections having the same cross-section said first and third straight sections being shorter than said second straight section, said first ends of said plurality of holding sticks being connected by a first end bar, said sixth ends of said plurality of holding sticks being connected by a second end bar said mounting plate providing for mounting said support device in at least one storage position and at least one selection position.

17. A support device for hanging a plurality of sheetlike objects, as claimed in claim 16, wherein said angle is about 90°.

18. A support device for hanging a plurality of sheetlike objects, as claimed in claim 16, wherein said cross-section has a flat top surface.

* * * * *